US008739328B2

(12) United States Patent
Duncan

(10) Patent No.: US 8,739,328 B2
(45) Date of Patent: Jun. 3, 2014

(54) INDEX DRAIN

(76) Inventor: Scott E Duncan, Santa Rosa, CA (US)

( * ) Notice: Subject to any disclaimer, the term of this patent is extended or adjusted under 35 U.S.C. 154(b) by 518 days.

(21) Appl. No.: 13/181,454

(22) Filed: Jul. 12, 2011

(65) Prior Publication Data

US 2012/0060274 A1 Mar. 15, 2012

Related U.S. Application Data

(60) Provisional application No. 61/382,802, filed on Sep. 14, 2010.

(51) Int. Cl.
*E03C 1/232* (2006.01)

(52) U.S. Cl.
USPC ..... 4/684

(58) Field of Classification Search
CPC ..... E03C 1/00
USPC ..... 4/679–694
See application file for complete search history.

(56) References Cited

U.S. PATENT DOCUMENTS

| | | | | |
|---|---|---|---|---|
| 3,174,926 | A * | 3/1965 | Walker et al. | 208/340 |
| 3,606,523 | A * | 9/1971 | Taylor | 359/665 |
| 5,848,478 | A * | 12/1998 | Duncan | 33/562 |
| 6,427,255 | B1 * | 8/2002 | Duncan | 4/295 |
| 6,755,215 | B2 * | 6/2004 | Duncan | 138/90 |
| 2002/0185421 | A1 * | 12/2002 | Quintel | 210/153 |

* cited by examiner

*Primary Examiner* — Lori Baker
(74) *Attorney, Agent, or Firm* — Steven A. Nielsen; Allman & Nielsen, P.C.

(57) ABSTRACT

A drain stopper assembly for selectively opening and closing a drain located within a basin, tub or sink, the drain having an opening within said basin, tub or sink for facilitating the selective passage of water there through and past its drain collar and drain body. A stopper is provided being selectively sealable on said drain collar allowing selective passage of water. The stopper is mechanically positioned within the drain body by a scooper end in mechanical communication with a lifting rod being actable from a position exterior to the drain body for selective raising and lowering of the scooper end wherein lowering the scooper end causes the stopper to seat upon the drain collar and raising the scooper causes the stopper to separate from the drain collar.

13 Claims, 29 Drawing Sheets

INDEX DRAIN

RELATED PATENT APPLICATION AND INCORPORATION BY REFERENCE

This is a utility application based upon U.S. patent application Ser. No. 61/382,802 filed on Sep. 14, 2010. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever.

BACKGROUND OF THE INVENTION (1) Field of the Invention

The index drain relates generally to drain stoppers for basins, tubs and sinks and more particularly to apparatus for actuating up and down movement of a drain stopper, and still more particularly to a mechanically operated pop-up assembly for opening and closing the drain stopper, and allowing for a complete removal of the drain stopper directly from the drain pipe without the use of tools.

(2) General Background of the Invention

Drain stoppers including lifting and linkage to drain assemblies have been employed for many years without any significant improvement. These drain stopper assemblies generally include a ball rod assembly and linkage connecting the lift rod to the drain stopper including a pivot bar connected to the lower end of the lift rod which, in turn, is connected to a valve stem having a ball valve exposed inside a radially extending elbow within the drain body. As a lift rod is pulled upwardly, the drain stopper moves downwardly to close the drain opening and as the drain rod is pushed downwardly, the drain stopper rises from the drain collar allowing the basin to drain accordingly.

In that the lift rod and pivot bar are linked to one another, it is extremely difficult to remove the drain stopper from its collar to clean the drain body. This linkage provides for a natural ledge which catches hair and other debris causing significant sanitary issues. In addition, such linkage oftentimes loosens reducing the control that a user has upon the orientation of the stopper by actuation of the lift rod. The linkage can oftentimes fail after repeated use and its repair requires the intervention of a plumber.

It is thus an object of the index drain to provide a novel control device for selectively moving a stopper to block or open a drain collar without the need for complex linkages contained within a commercial or residential basin, tub or sink drain pipe.

It is a further object of the index drain to provide a novel installation in which a stopper can be removed from its supporting drain collar by merely turning and lifting the stopper there from and without the need for disengaging complex linkages ordinarily found within such installation.

It is yet a further object of the index drain to provide a novel system which, upon removal of its stopper; provides a user within an unobstructed passage along the interior of the system's drain pipe for ease of cleaning and maintenance.

It is still a further object of the index drain to provide actuation of a stopper to selectively open and close a drain collar relying solely upon an inexpensive and simple indexed mechanical assembly to position the drain stopper with the drain, on or above the drain collar thus obviating the need for any of the complex linkage necessitated by the prior art.

It is yet still a further object of the index drain to provide a novel drain stopper assembly which can be retrofitted, installed and/or connected quickly without extensive use of tools or knowledge of complex plumbing considerations requiring only tubing and press fit fittings to complete a typical installation.

Yet a further object of the index drain is to provide a stoppage proof drain that eliminates an obstruction potential.

Another separate and further object of the index drain is to provide a quiet and attractive drain stopper assembly that can be retrofitted easily onto standard drain stoppers for basins, tubs and sinks.

Yet a further and separate object of the index drain is to provide a stopper assembly to catch and hold items such as jewelry, medicine capsules or pills, razor blades, and the like, to prevent the items from going down the sewer.

In the disclosed diverter index drain embodiment, hair and other debris are diverted way from the ball rod assembly and the scooper end does not generally protrude within the drain. These features and other features result in a vast improvement in keeping the drain system free of hair and other debris.

SUMMARY OF THE INVENTION

In the disclosed diverter index drain embodiment and other disclosed embodiments, many significant and unobvious advantages over the prior art are presented. For example, a hair diverter deflects hair away from a scooper end insertion area, such that hair flows freely down the drain. The configuration of the scooper end insertion area and flattened scooper end provides effortless removal and cleaning of a diverter index drain. Moreover, unlike the known related art, the interior section of the diverter index drain is devoid of significant obtrusions, vastly improving sanitary conditions. A disclosed diverter index drain embodiment includes a retro-fit kit allowing for easy removal and replacement of prior art assemblies. A disclosed flattened scooper end may be installed into a diverter index drain without the use of tools, thus encouraging periodic removal of the diverter index drain for cleaning. Angled grates stop rings and other objects from entering the drain system but yet provide excellent drain flow.

An index drain provides a stopper assembly for selectively opening and closing a drain located within a basin, tub or sink, the drain having an opening within said basin, tub or sink for facilitating the selective passage of water there through and past a drain collar and a drain body. A sanitary stopper is provided being selectively sealable on the drain collar allowing selective passage of water. The index drain includes a unitary ball-rod scooper assembly positioned within the drain body, and a mechanical linkage in communication with the unitary ball-rod scooper assembly being actuated from a position exterior to the drain body for selective movement of the scooper causing the stopper to separate from the drain collar or to seat upon the drain collar. An embodiment of the index drain includes a sanitary stopper that is removable from a position above the drain collar to access and clean a portion of the drain.

An index drain overcomes shortfalls in the known prior art by providing a more sanitary drain area. In the known prior art, hair and other organic debris tends to build up within bathroom drains, were consumers often brush hair and rinse out mouths after teeth brushing. In the prior art, ball rods or other means of lifting a drain stop are often fouled by debris passing down the sink. Disclosed index drains wherein overcome this shortfall by providing a more streamlined stopper operation system so as to not ensnare hair and other health hazards traveling down the drain.

Disclosed linkage assemblies overcome shortfalls in the known prior art by being more ADA (Americans with Disabilities Act) compliant. A disclosed boot system eschews the need for sharp fasteners often found under a bathroom sink in the prior art. The disclosed boot system does not need to be wrapped in neoprene or other softening material.

BRIEF DESCRIPTION OF THE DRAWINGS

The above stated features and other aspects and advantages of the index drain will become more apparent and better understood after consideration of the following description and accompanying drawings as further described.

REFERENCE NUMERALS IN THE DRAWINGS

Figure 1:
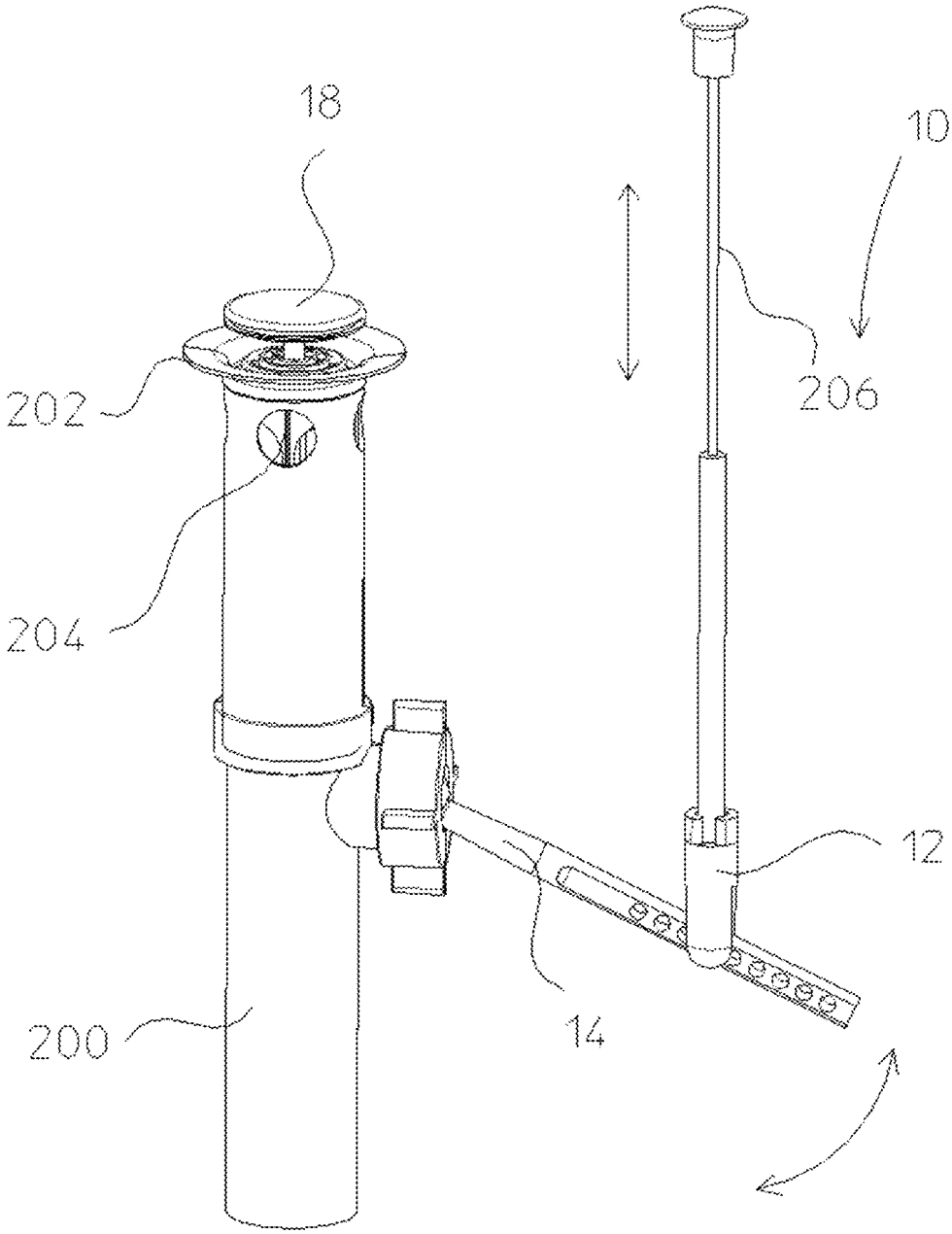
FIG. 1 is a perspective view one embodiment of the index drain.
Figure 7:
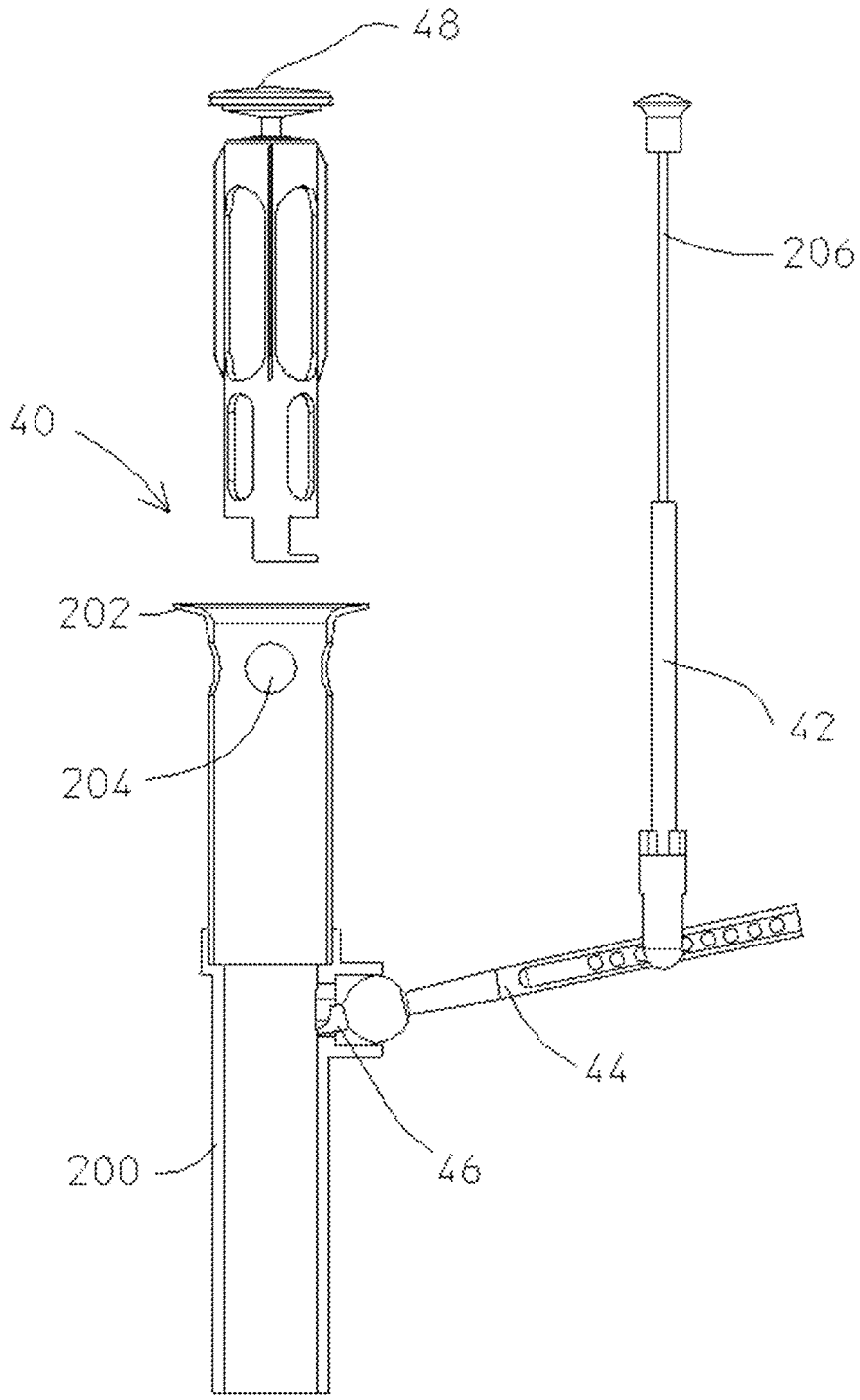
FIG. 7 is a perspective view of an embodiment of the index drain.
Figure 12:
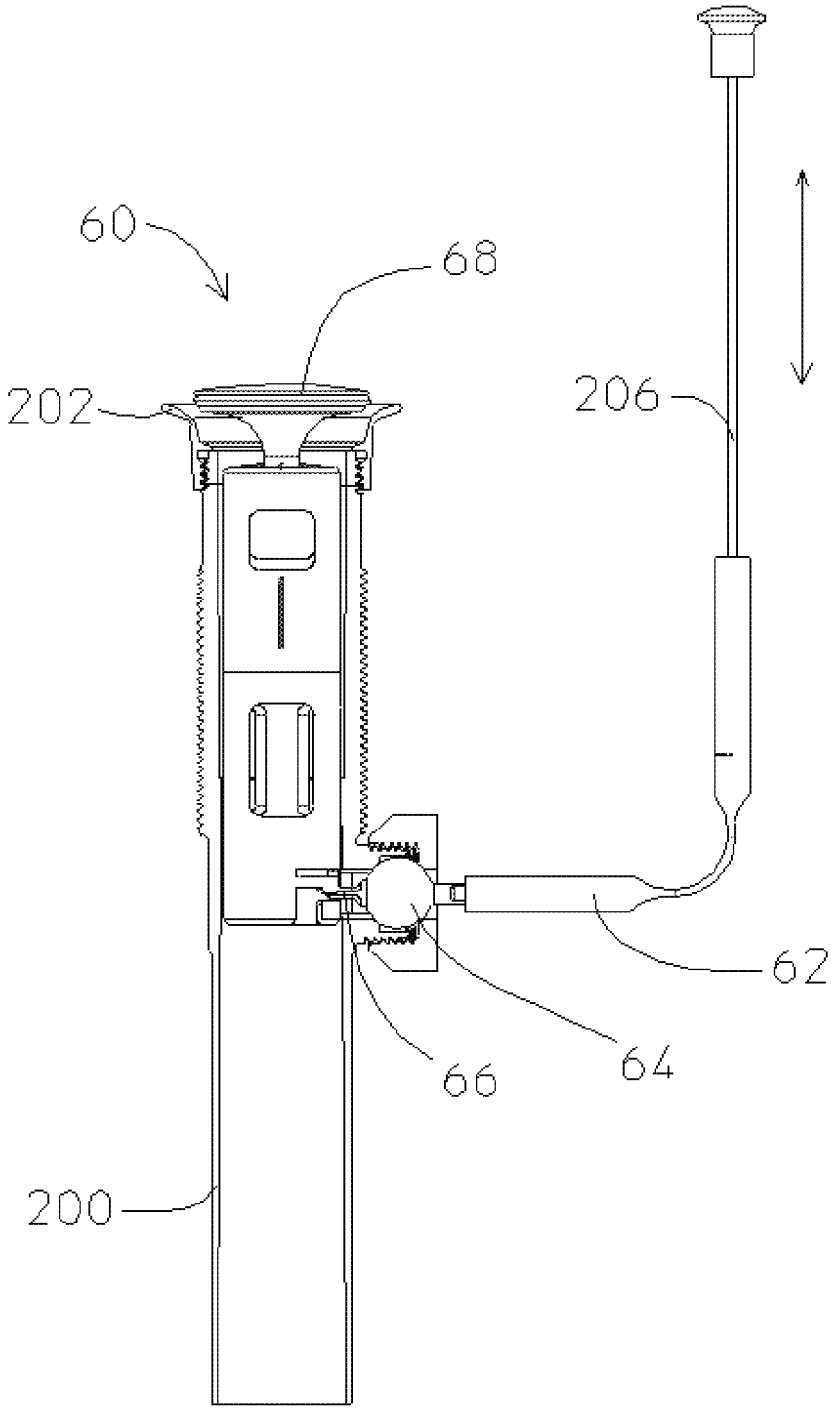
FIG. 12 is a partial sectional perspective view of one embodiment of the index drain.
Figure 42:
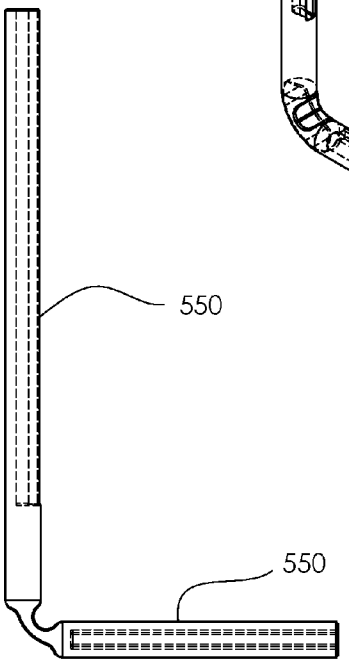
FIG. 42 is a side view of a L shaped lifting rod boot
Figure 41:
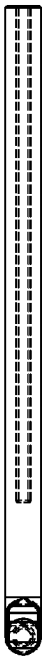
FIG. 41 is a view of a L shaped lifting rod boot
Figure 40:
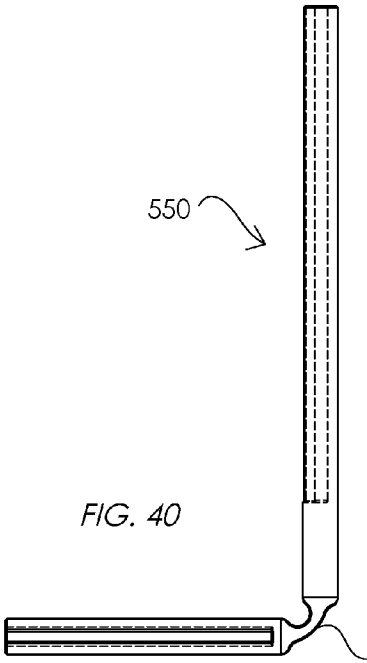
FIG. 40 is an elevation view of a L shaped lifting rod boot
Figure 39:
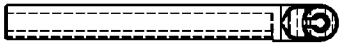
FIG. 39 is a view of a L shaped lifting rod boot

10 one embodiment of the index drain, shown in FIG. 1 and several other figures
12 quick connect clasp
14 unitary ball-rod scooper assembly
16 scooper end
18 sanitary stopper for embodiment of FIG. 1
40 one embodiment of the index drain, shown in FIG. 7 and other figures
42 quick connect clasp for embodiment of FIG. 7
44 unitary ball-rod scooper assembly for embodiment of FIG. 7
46 scooper end for embodiment of FIG. 7
48 sanitary stopper for embodiment of FIG. 7
60 one embodiment of the index drain, shown in FIG. 12 and other drawings
68 sanitary stopper for embodiment of FIG. 12.
62 quick connect L-connector
64 unitary ball-rod scooper assembly for embodiment of FIG. 12
66 scooper end for embodiment of FIG. 12
68 sanitary stopper of FIG. 12

Figure 17:
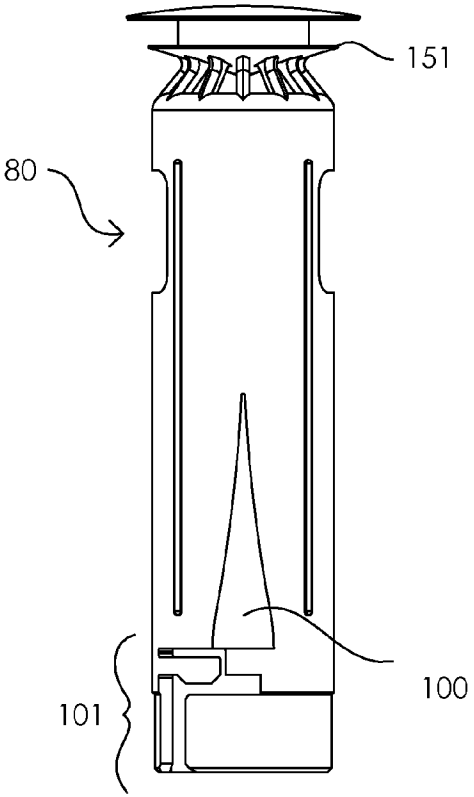
FIG. 17 is perspective view of one embodiment of the index drain having a hair diverter.

80 one embodiment of the index drain as shown in FIG. 17, also known as the index drain with diverters or a diverter index drain
88 sanitary stopper of FIG. 17 or sanitary stopper of the diverter index drain
100 hair diverter
101 scooper end insertion area
102 rectangular voids of diverter index drain used for overflow. Sometimes called overflow voids.
103 vertical diverter
150 angled drain grate
151 gasket support, found above angled drain gate 150 and below the sanitary stopper support structure 152
152 sanitary stopper support structure, sometimes found below sanitary stopper of FIG. 17
200 standard drain pipe
201 threaded section of a drain pipe 200
202 drain collar
204 overflow holes
206 lifting rod, sometimes called a plunger rod or vertical rod
207 fitting cap to retain ball into ball chamber 208
208 holding chamber for ball
300 hair
400 ball
401 ball rod
402 circular ball rod section
403 protrusion section of ball rod
404 base of scooper end or scooper end base
405 flattened scooper end
406 threaded section of base of scooper end 404
407 threaded section sometimes found in interior of ball 400
408 interior section or interior void of the diverter index drain
500 lifting rod boot, sometimes called the T lifting rod boot
501 vertical section of lifting rod boot
502 horizontal section of lifting rod boot
503 fitting void within horizontal section of lifting rod boot
504 fitting void within vertical section of lifting rod boot
505 main center void within horizontal section of lifting rod boot
506 flexible angle joint connecting the horizontal section 502 of the lifting rod boot to the vertical section 501 of the lifting rod boot
550 a L shaped lifting rod boot sometimes called the L lifting rod boot
551 a living hinge joint of a L shaped lifting rod boot
552 a vertical section of a L shaped lifting rod boot
553 a horizontal section of a L shaped lifting rod boot
600 snap section sometimes used to secure a flattened scooper
601 horizontal passageway for a flattened scooper
602 a first beveled ridge leading into a horizontal passage way for a flattened scooper
603 a second beveled ridge exiting a horizontal passage 601 and leading to a vertical snap section void
604 scooper resting void
605 solid section of index drain defining an upper section of a resting void 604 and defining a vertical section of a vertical void 607 of snap section 600
606 an upper horizontal void section defined by a snap section 600 and an upper section 611 of an index drain with diverters
607 a vertical void defined by a lower section 608 of a diverter index drain 80, a snap section 600 and a solid section 605 of a diverter index drain.
608 a lower solid section of a diverter index drain 80, with one side of the lower solid section defining one vertical edge of a scooper entry void 609
609 a scooper entry void leading into a horizontal passageway 601
610 a first bottom edge of a snap section 600
611 an upper section of an index drain with diverters
612 the upper edge of a snap section 600
613 the second lower edge of snap section 600
614 a vertical edge of the snap section 600
615 an upper horizontal edge of the lower solid section 608 of the diverter index drain 80
616 a vertical edge perpendicular to the upper horizontal edge 615 of the lower solid section 608

Referring to FIG. 1, a perspective view of an embodiment of index drain 10 including a sanitary stopper 18 within a standard drain pipe 200 for residential basins, tubs and sinks, the drain pipe 200 having a drain collar 202, overflow holes 204 and lifting rod 206, with a quick connect clasp 12 affixing a lifting rod 206 bottom end to a unitary ball-rod scooper assembly 14.

Figure 2:
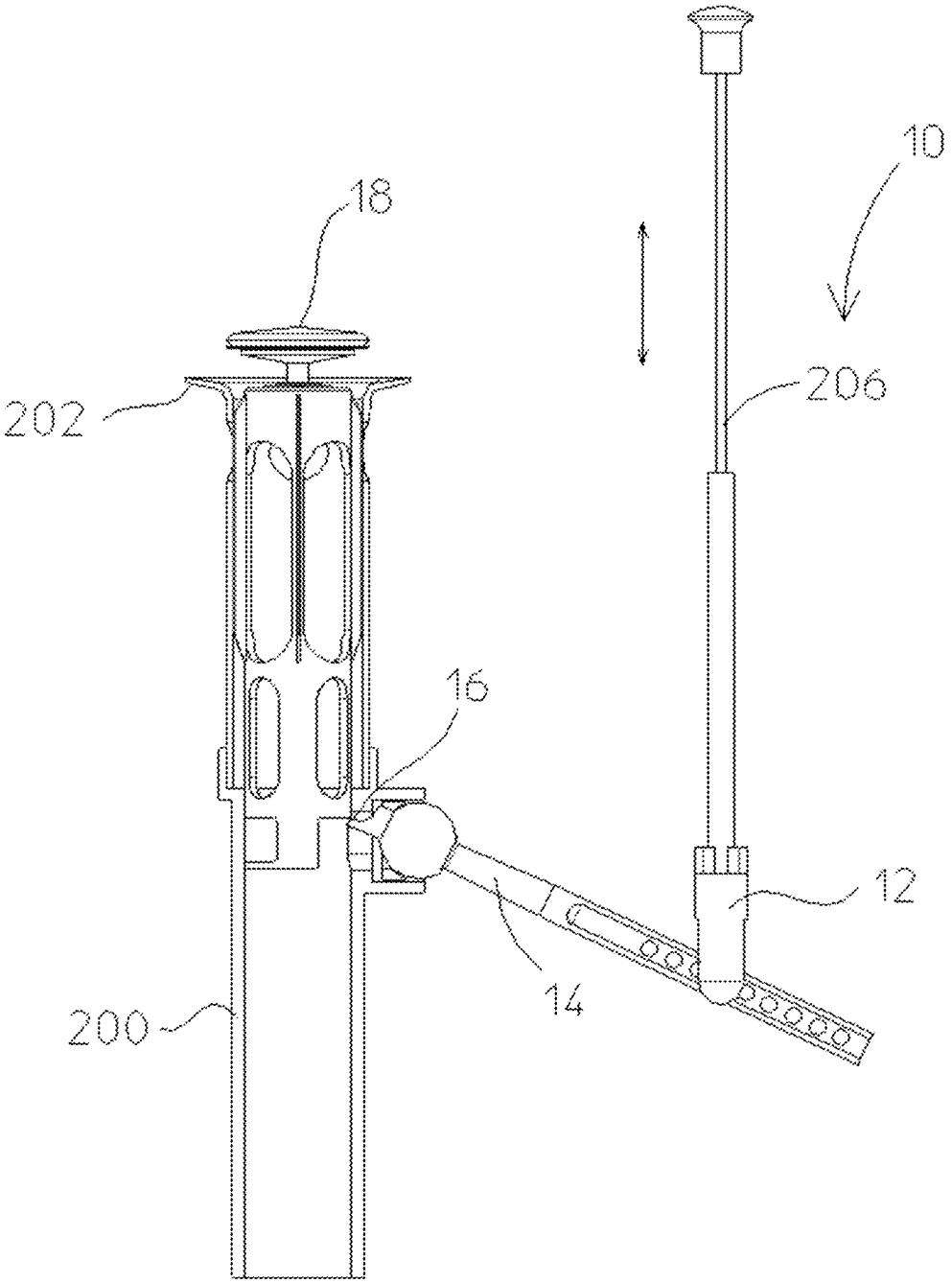
FIG. 2 is a perspective view of one embodiment of the index drain.

FIG. 2 is a perspective view of the embodiment of index drain 10 of FIG. 1 including a sanitary stopper 18 within section view of standard drain pipe 200 for basins, tubs and sinks, the drain pipe 200 having a drain collar 202, overflow holes 204 and lifting rod 206, with a quick connect clasp 12 affixing a lifting rod 206 bottom end to a unitary ball-rod scooper assembly 14 wherein downward action of the lifting rod 206 lifts the scooper end 16, which in turn lifts the bottom of the sanitary stopper 18 causing the sanitary stopper 18 to separate from the drain collar 202.

Figure 3:
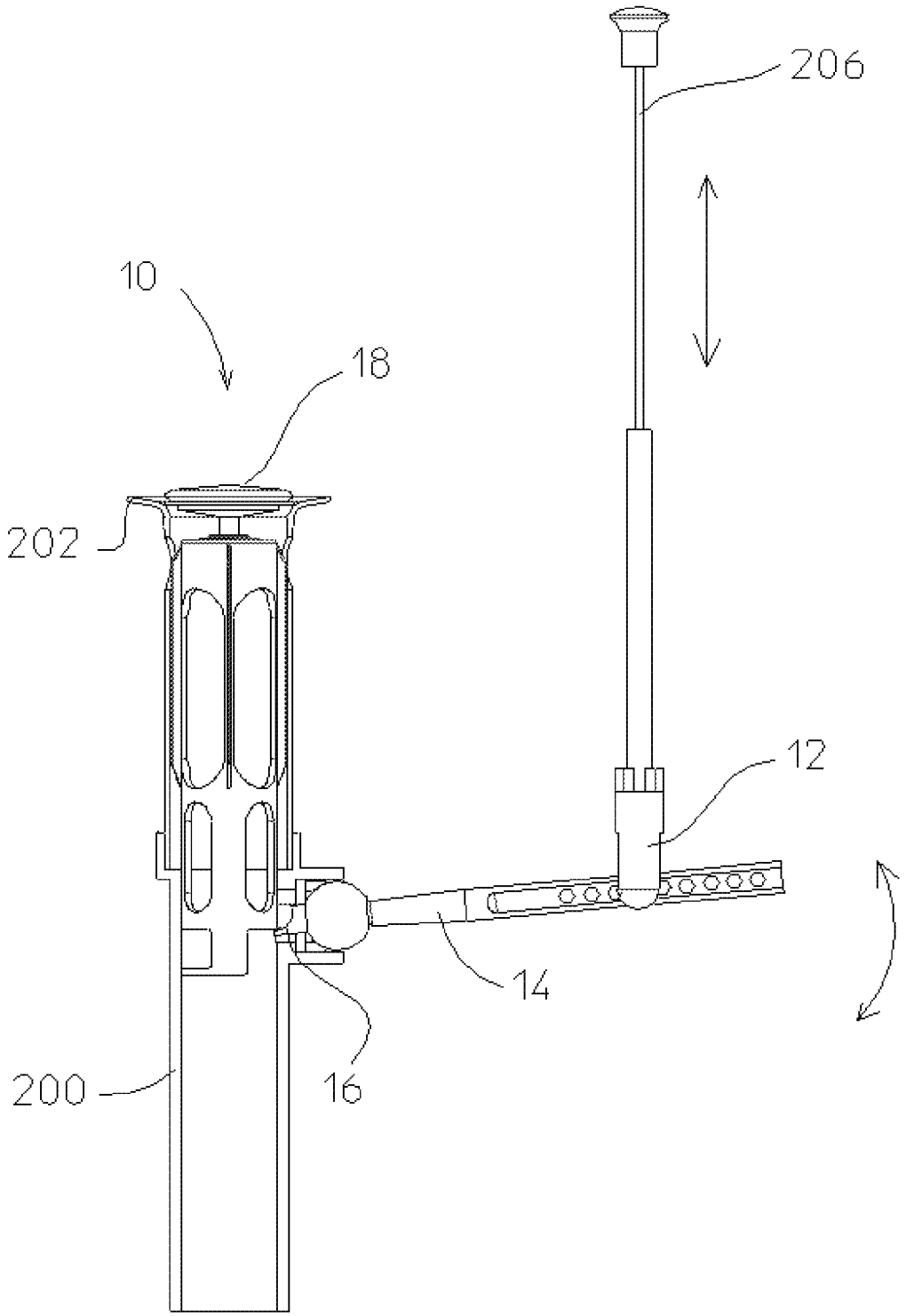
FIG. 3 is a perspective view of one embodiment of the index drain.

FIG. 3 is a perspective view of the embodiment of index drain 10 of FIG. 1 including a sanitary stopper 18 within section view of standard drain pipe 200 for basins, tubs and sinks, the drain pipe 200 having a drain collar 202, overflow holes 204 and lifting rod 206, with a quick connect clasp 12 affixing a lifting rod 206 bottom end to a unitary ball-rod scooper assembly 14 wherein upward action of the lifting rod 206 lowers the scooper end 16, which in turn lowers the bottom of the sanitary stopper 18 causing the sanitary stopper 18 to seat upon the drain collar 202.

Figure 4:
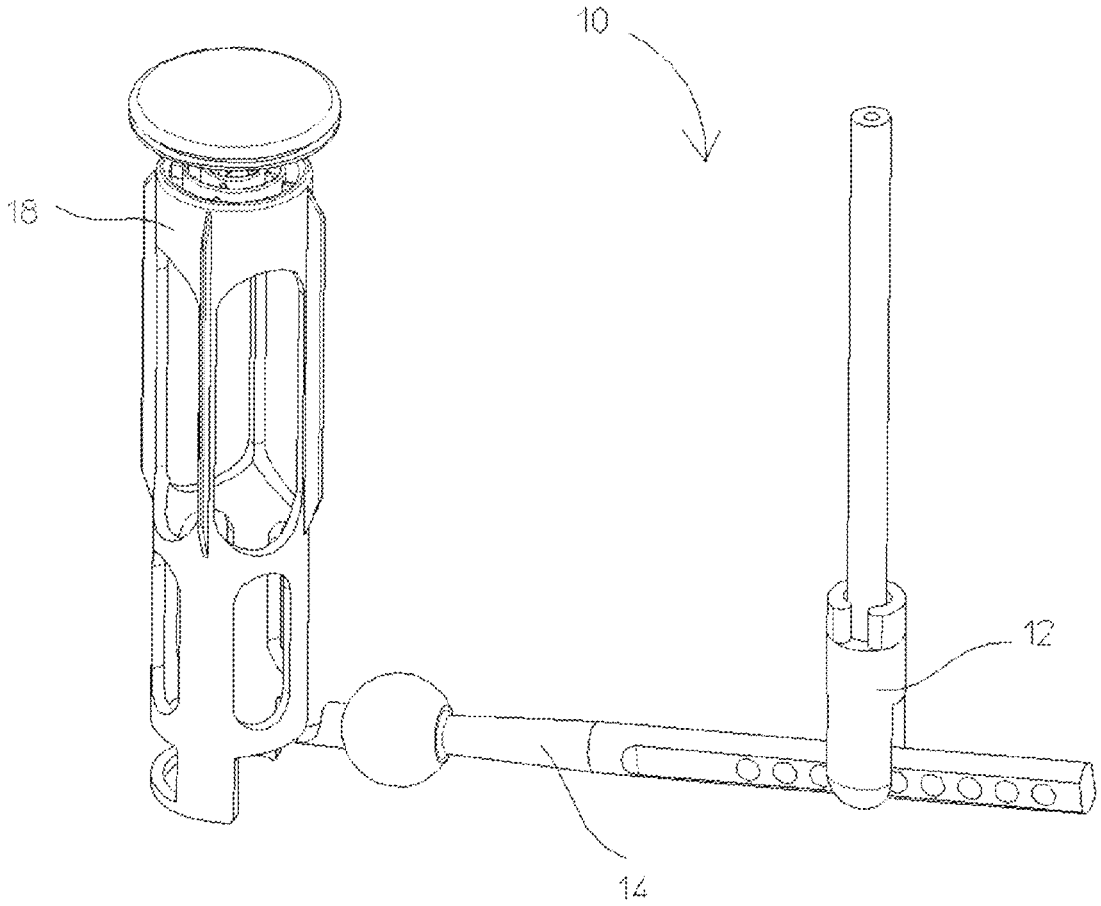
FIG. 4 is a perspective view of one embodiment of the index drain.

FIG. 4 is an exploded perspective view of the embodiment of index drain 10 of FIG. 1 including a sanitary stopper 18, a quick connect clasp 12, a unitary ball-rod scooper assembly 14, and scooper end 16.

Figure 5:
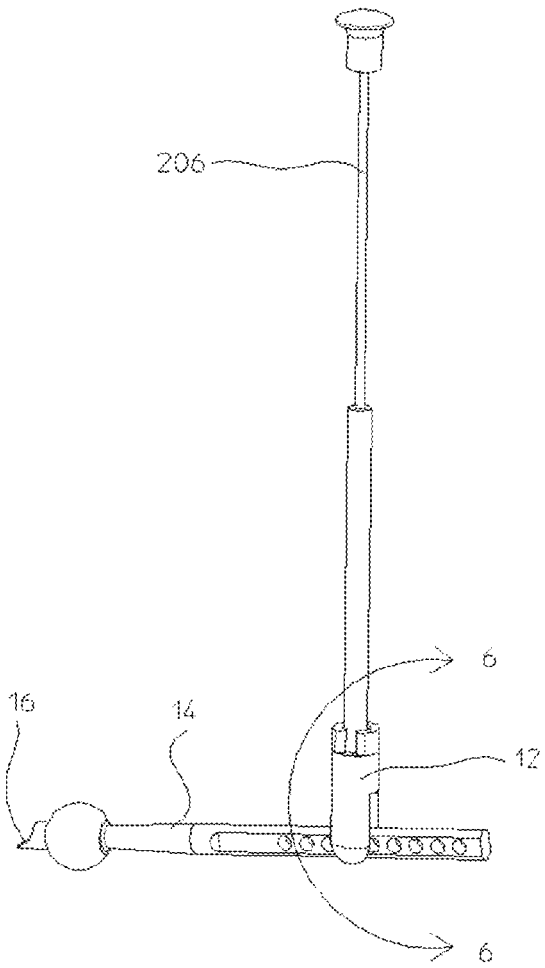
FIG. 5 is detailed perspective view of an embodiment of a quick connect clasp and other related parts.

FIG. 5 is a detailed perspective view of the quick connect clasp 12 and lifting rod 206 pivotally affixed to the unitary ball-rod scooper assembly 14 with scooper end 16 for an embodiment of index drain 10 of FIG. 1.

Figure 6:
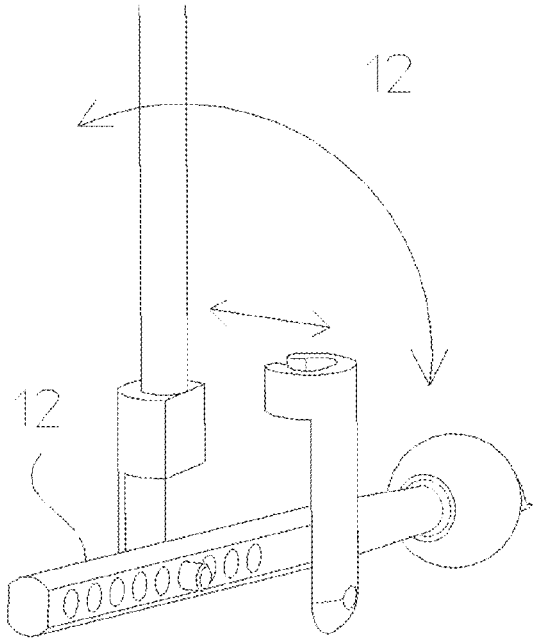
FIG. 6 is a detailed perspective view of an embodiment of a quick connect clasp and other related parts.

FIG. 6 is a detailed exploded perspective view of the quick connect clasp 12 pivotally affixed to the unitary ball-rod scooper assembly 14 for an embodiment of index drain 10 taken at 6-6 of FIG. 5.

FIG. 7 is an exploded perspective view of an embodiment of index drain 40 including a sanitary stopper 48 removed for sanitary bottle brush cleaning from a standard drain pipe 200 for commercial basins, tubs and sinks, the drain pipe 200 having a drain collar 202, overflow holes 204 and lifting rod 206, with a quick connect clasp 42 affixing a lifting rod 206 bottom end to a unitary ball-rod scooper assembly 44 having a scooper end 46.

Figure 8:
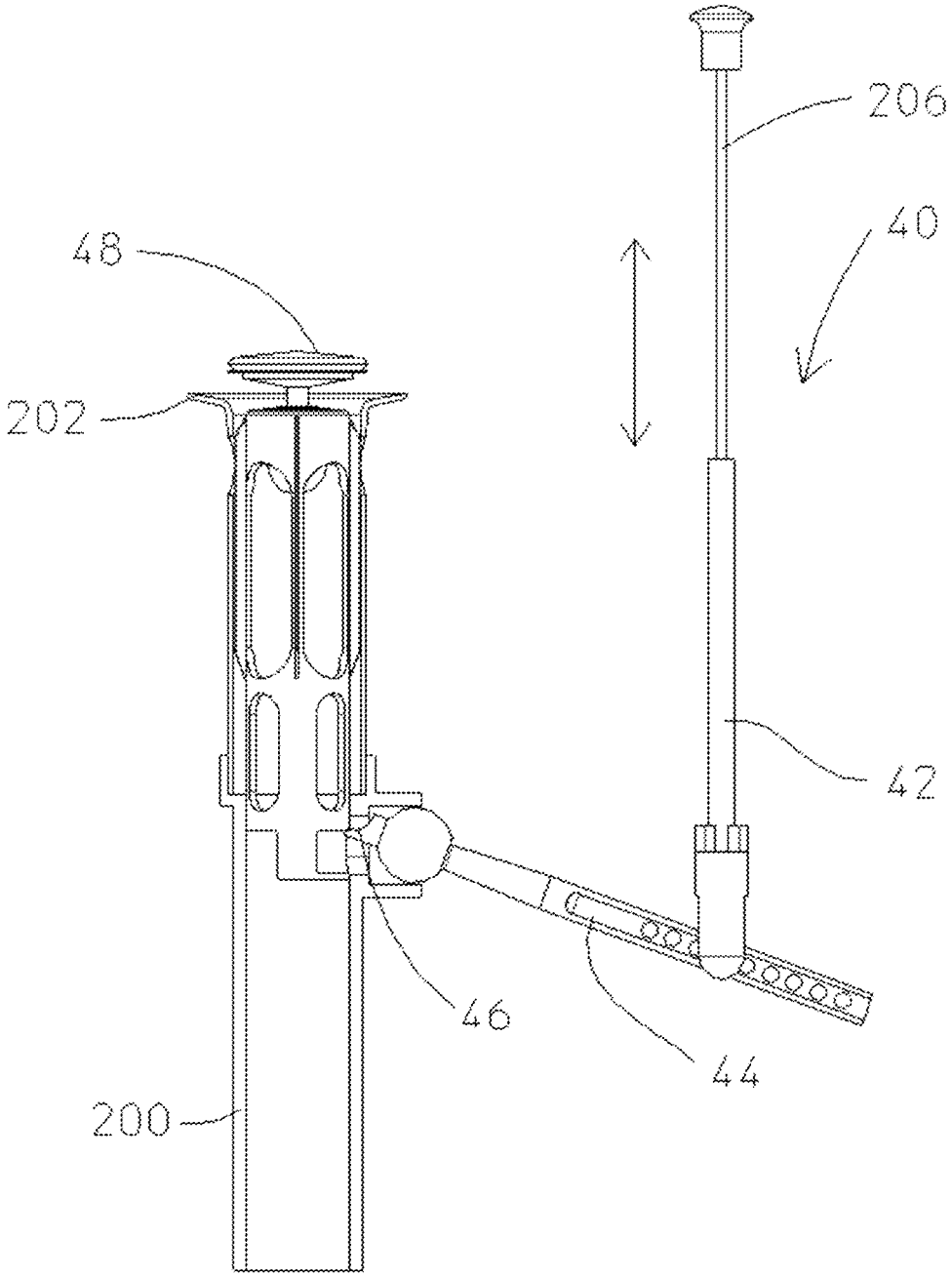
FIG. 8 is a partial sectional perspective view of one embodiment of the index drain.

FIG. 8 is a partial sectional perspective view of the embodiment of index drain 40 of FIG. 7 including a sanitary stopper 48 in a position for removal for sanitary bottle brush cleaning from a standard drain pipe 200 for commercial basins, tubs and sinks, the drain pipe 200 having a drain collar 202, overflow holes 204 and lifting rod 206 moved to and held in an up position, with a quick connect clasp 42 affixing a lifting rod 206 bottom end to a unitary ball-rod scooper assembly 44 having a scooper end 46.

Figure 9:
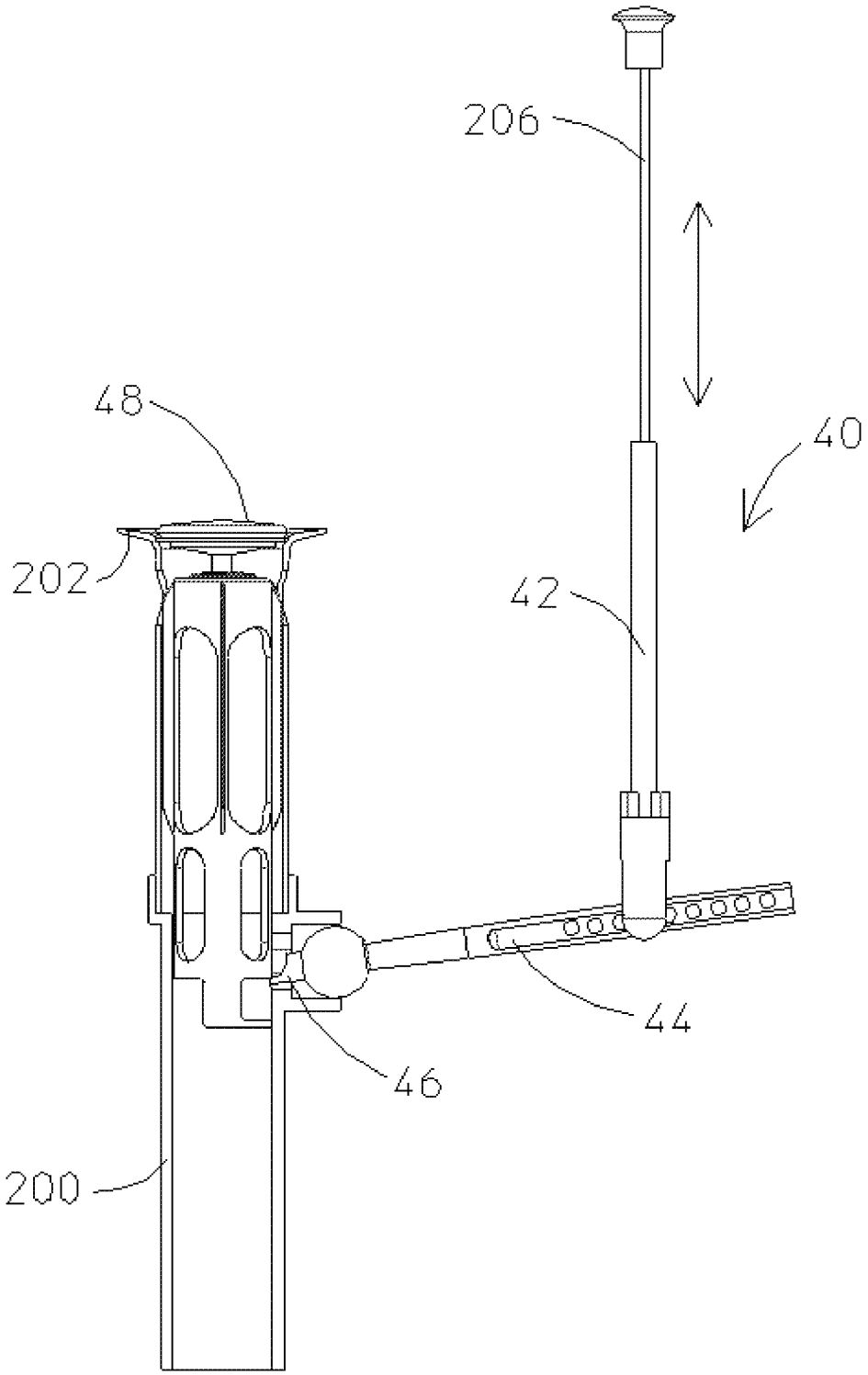
FIG. 9 is a partial sectional perspective view of one embodiment of the index drain.

FIG. 9 is a partial sectional perspective view of the embodiment of index drain 40 of FIG. 7 including a sanitary stopper 48 in a standard drain pipe 200 for commercial basins, tubs and sinks, the drain pipe 200 having a drain collar 202 and lifting rod 206 moved in an up position, with a quick connect clasp 42 affixing a lifting rod 206 bottom end to a unitary ball-rod scooper assembly 44 having a scooper end 46, wherein upward action of the lifting rod 206 lowers the scooper end 46, which in turn lowers the bottom of the sanitary stopper 48 causing the sanitary stopper 48 to seat upon the drain collar 202.

Figure 10:
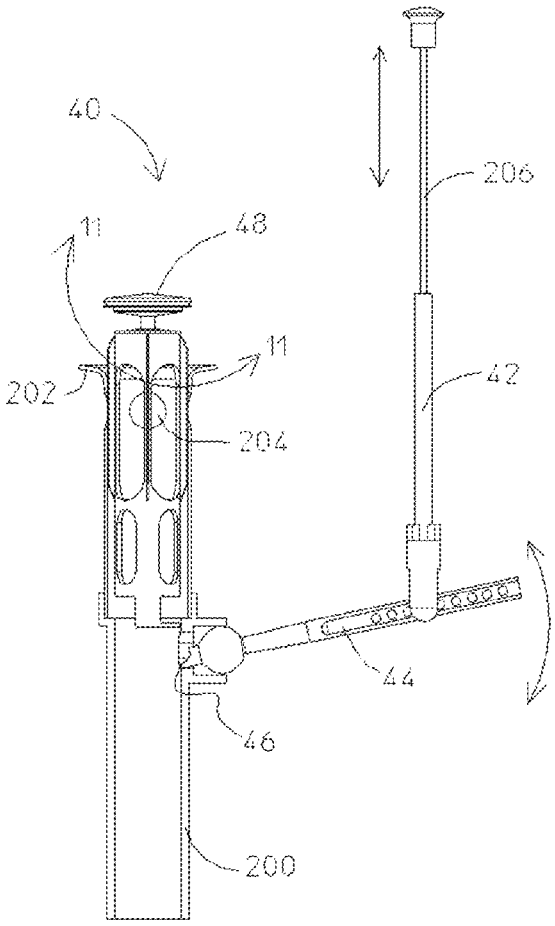
FIG. 10 is a partial sectional perspective view of one embodiment of the index drain.

FIG. 10 is a partial sectional perspective view of the embodiment of index drain 40 of FIG. 7 including a sanitary stopper 48 in a partially raised position for removal or retrieval of items caught in the stopper within a standard drain pipe 200 for commercial basins, tubs and sinks, the drain pipe 200 having a drain collar 202, overflow holes 204 and lifting rod 206 moved to and held in an up position, with a quick connect clasp 42 affixing a lifting rod 206 bottom end to a unitary ball-rod scooper assembly 44 having a scooper end 46.

Figure 11:
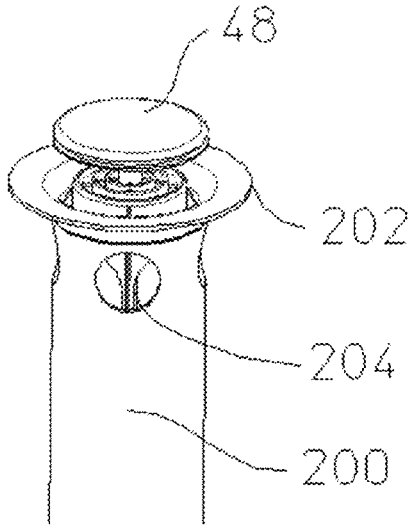
FIG. 11 is a detailed exploded perspective view of an embodiment of a sanitary stopper and related parts.

FIG. 11 is a detailed exploded perspective view of the sanitary stopper 48 in a partially raised position for removal or retrieval of items caught in the stopper within a standard drain pipe 200 for commercial basins, tubs and sinks, the drain pipe 200 having a drain collar 202, overflow holes 204 for an embodiment of index drain 40 taken at "11-11" of FIG. 10.

FIG. 12 is a partial sectional perspective view of an embodiment of index drain 60 including a sanitary stopper 68 within a standard drain pipe 200 for basins, tubs and sinks, the drain pipe 200 having a drain collar 202, overflow holes 204 and lifting rod 206, with a quick connect, L-connector 62 affixing a lifting rod 206 bottom end to a unitary ball-rod scooper assembly 64 having scooper end 66.

Figure 13:
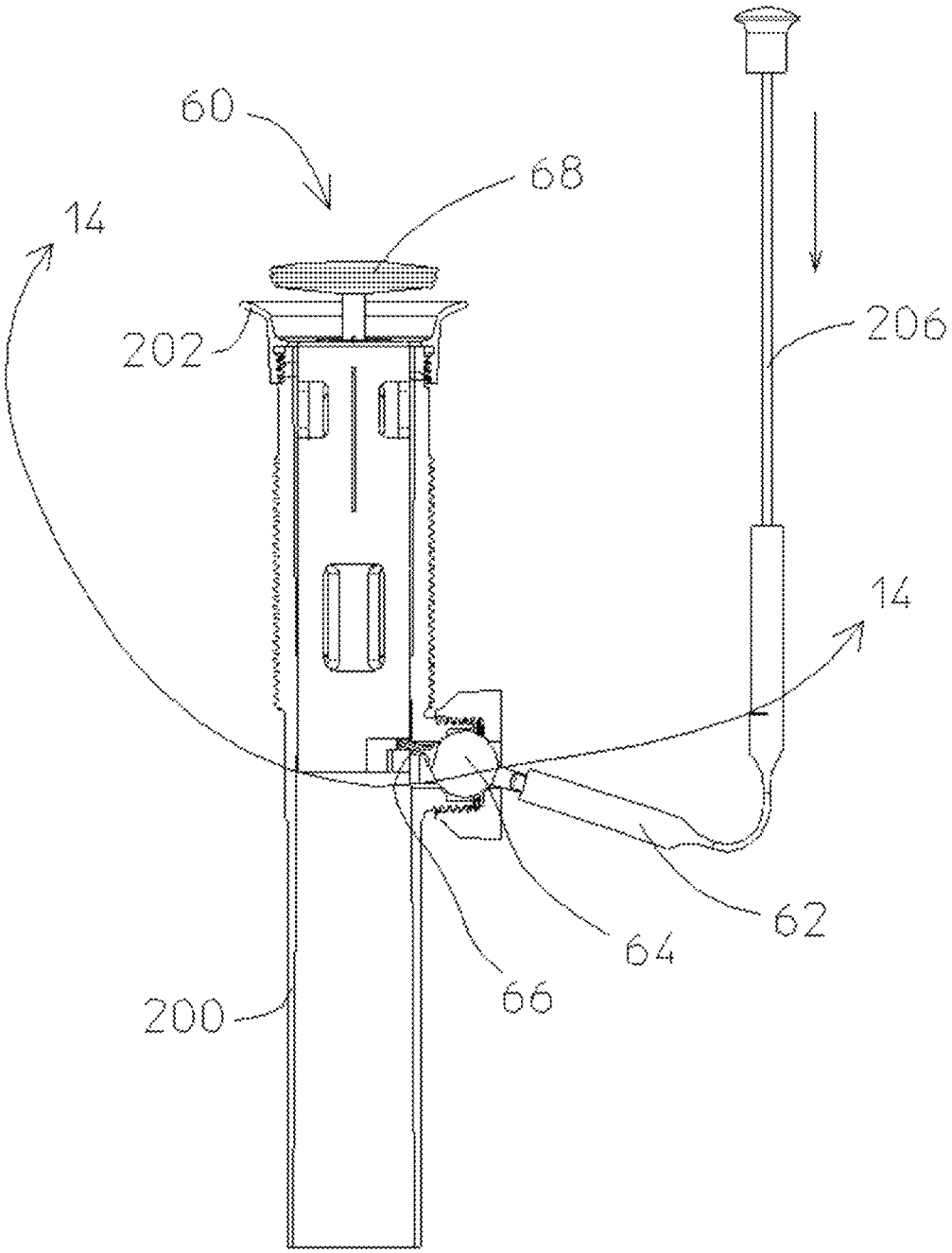
FIG. 13 is a perspective view of one embodiment of the index drain.

FIG. 13 is a perspective view of the embodiment of index drain 60 of FIG. 12 including a sanitary stopper 68 within a section view of standard drain pipe 200 for basins, tubs and sinks, the drain pipe 200 having a drain collar 202 and lifting rod 206, with a quick connect, L-connector 62 affixing a lifting rod 206 bottom end to a unitary ball-rod scooper assembly 64 wherein downward action of the lifting rod 206 lifts the scooper end 66, which in turn lifts the bottom of the sanitary stopper 68 causing the sanitary stopper 68 to separate from the drain collar 202.

Figure 14:
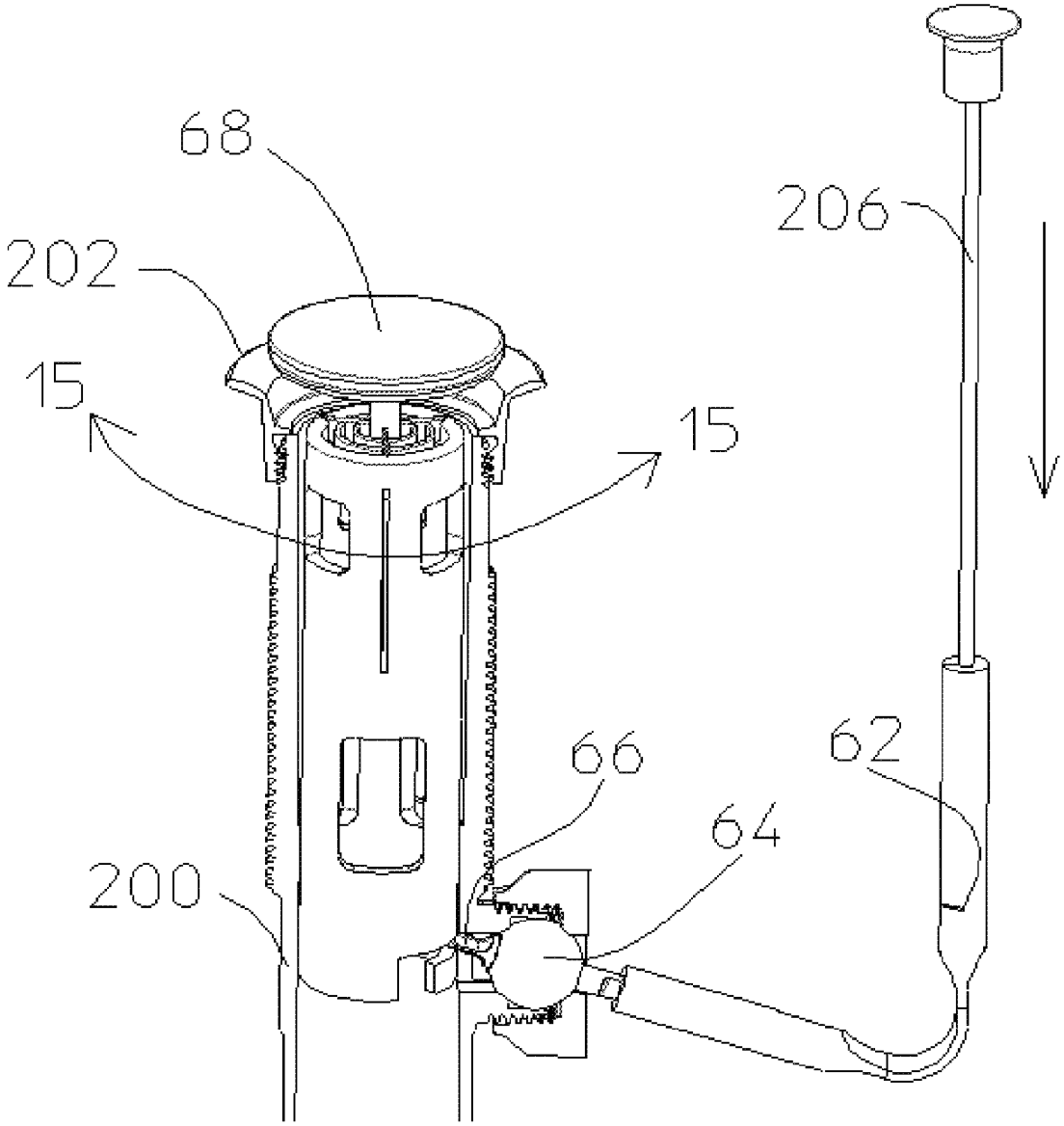
FIG. 14 is an enlarged detail perspective view of one embodiment of the index drain.

FIG. 14 is an enlarged detail perspective view of the embodiment of index drain 60 of FIG. 13 taken at "14-14."

Figure 15:
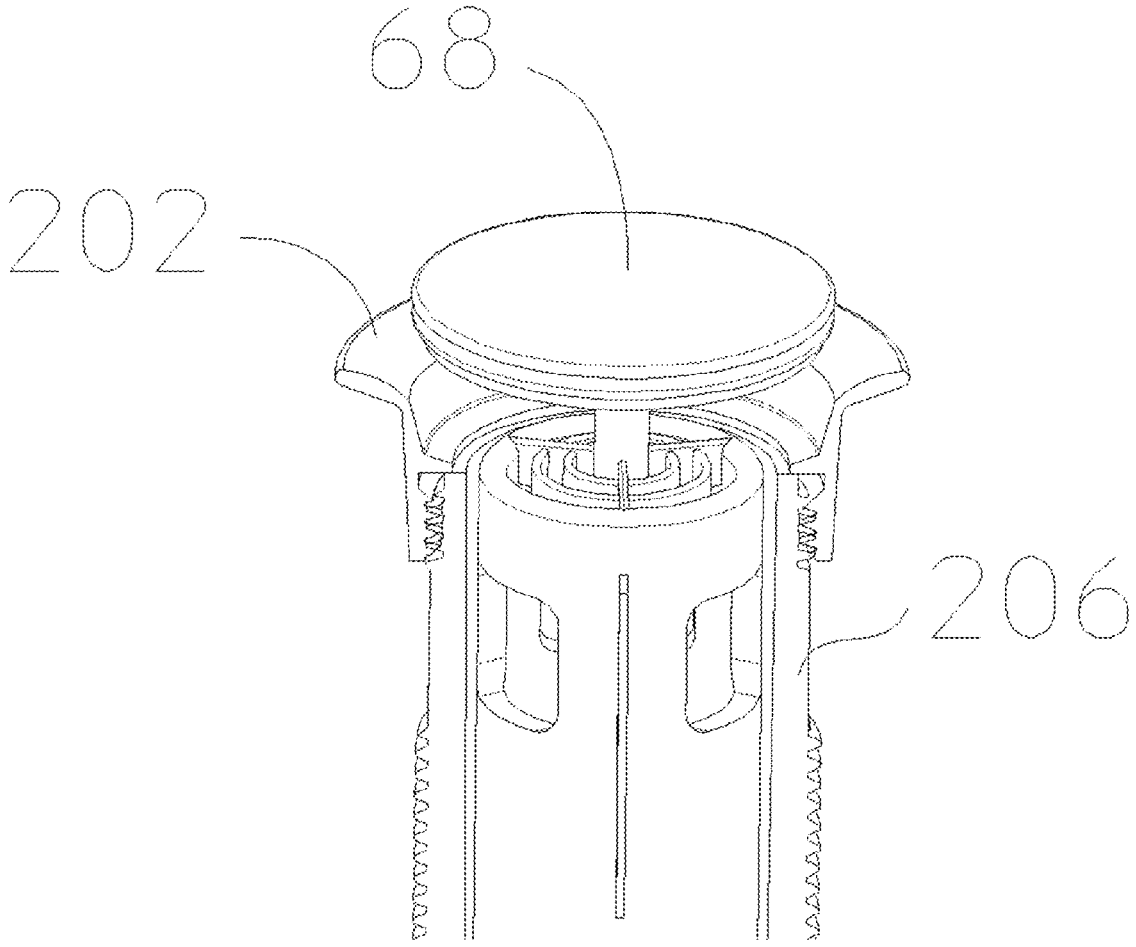
FIG. 15 is an enlarged detail perspective view of one embodiment of the index drain.

FIG. 15 is an enlarged detail perspective view of the embodiment of index drain 60 of FIG. 14 taken at "15-15" depicting the open side wall area which allows hair to travel freely without obstruction, while larger objects such as pills, jewelry, and the like are trapped between the sanitary stopper 68 top and the sanitary stopper 68 internal grates.

Figure 16:
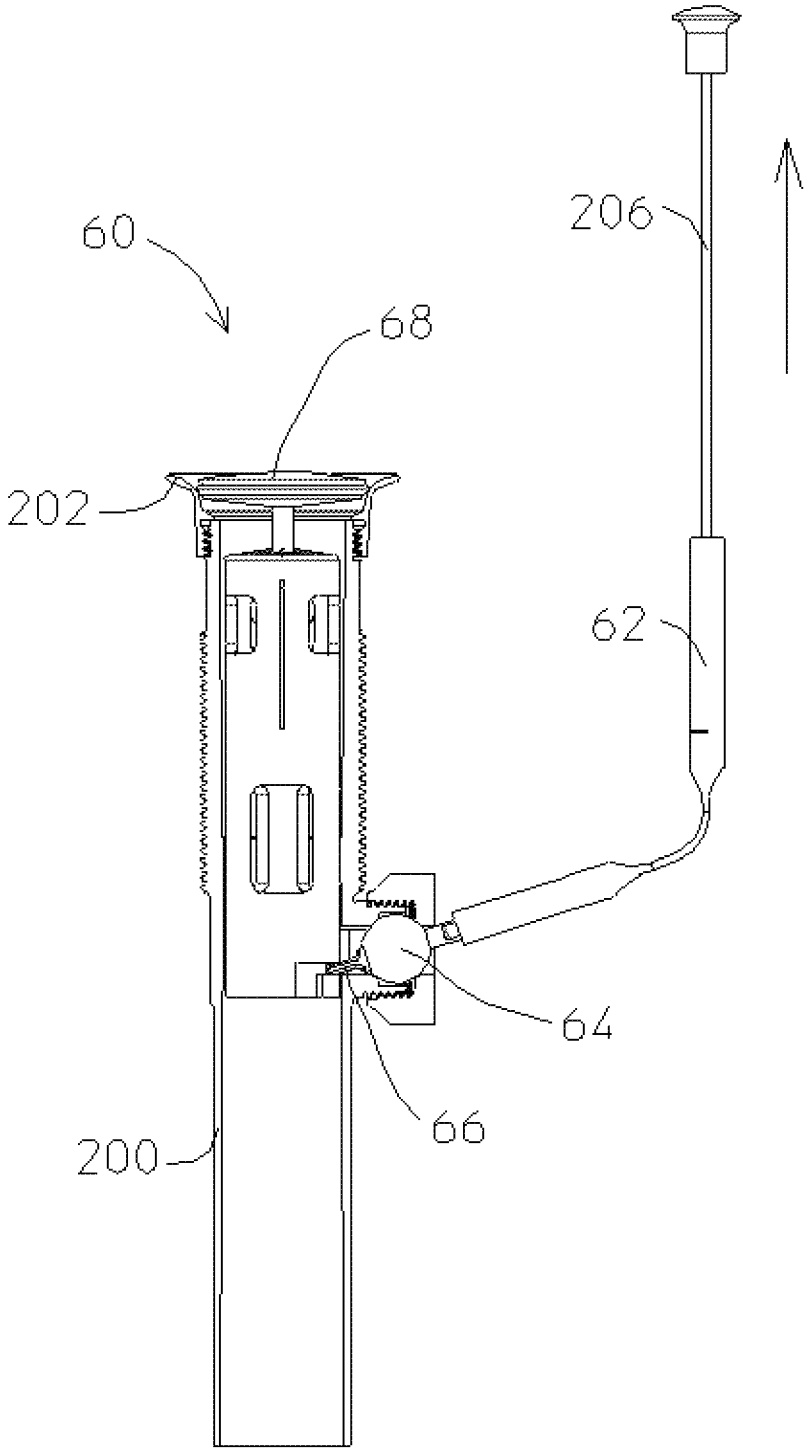
FIG. 16 is a perspective view of one embodiment of the index drain.

FIG. 16 is a perspective view of the embodiment of index drain 60 of FIG. 12 including a sanitary stopper 68 within a section view of standard drain pipe 200 for basins, tubs and sinks, the drain pipe 200 having a drain collar 202 and lifting rod 206, with a quick connect, L-connector 62 affixing a lifting rod 206 lowers the scooper end 66, which in turn lowers the bottom of the sanitary stopper 68 causing the sanitary stopper 68 to seat upon the drain collar 202.

A First Mode for Carrying out an Embodiment of the Invention Considering FIGS. 1 to 16

In this first mode of operation, FIGS. 1 through 16 illustrate a new and improved index drain. This description of a first mode does not limit the scope of the claims or the Second Mode as described below. In this first mode, FIGS. 1 to 16 show a new and improved index drain stopper apparatus, adapted for installation on a conventional sink, tub or basin drain pipe 200 having a drain collar 202, overflow holes 204 and a lifting rod 206.

An embodiment of index drain 10 includes a sanitary stopper 18 within a standard drain pipe 200 for residential basins, tubs and sinks, the drain pipe 200 having a drain collar 202, overflow holes 204 and lifting rod 206, with a quick connect clasp 12 affixing a lifting rod 206 bottom end to a unitary ball-rod scooper assembly 14, FIGS. 1-6. The quick connect clasp 12 provides one end sized to receive and hold a lifting rod 206 end. The quick connect clasp 12 further provides a second end including a clasp connector sized to receive and pivotally engage one of a plurality of holes aligned longitudinally along one end of the unitary ball-rod scooper assembly 14, FIGS. 5 and 6.

A second end of the unitary ball-rod scooper assembly 14 provides a sphere sized to rotatably communicate within an opening in the drain pipe 200 side, FIGS. 1-5. The sanitary stopper 18 further provides a solid circular top portion that is sized to fit upon and seal the drain collar 202, FIGS. 2-5. The sanitary stopper 18 cylindrical sides have slotted openings, FIG. 2-4.

The unitary ball-rod scooper assembly 14 sphere tapers to a lip portion sized to positionally communicate with a groove in the sanitary stopper 18 bottom such that movement of the lifting rod is transferred to the sanitary stopper 18. Downward action of the lifting rod 206 lifts the scooper end 16 of the index drain 10, which in turn lifts the bottom of the sanitary stopper 18 causing the sanitary stopper 18 to separate from the drain collar 202, FIG. 2. Upward action of the lifting rod 206 lowers the scooper end 16 of the index drain 10, which in turn lowers the bottom of the sanitary stopper 18 causing the sanitary stopper 18 to seat upon the drain collar 202, FIG. 3.

An embodiment of index drain 40 includes a sanitary stopper 48 within a standard drain pipe 200 for residential basins, tubs and sinks, the drain pipe 200 having a drain collar 202, overflow holes 204 and lifting rod 206, with a quick connect clasp 42 affixing a lifting rod 206 bottom end to a unitary ball-rod scooper assembly 44, FIGS. 7-11. The quick connect clasp 42 provides one end sized to receive and hold a lifting rod 206 end. The quick connect clasp 42 further provides a second end including a clasp connector sized to receive and pivotally engage one of a plurality of holes aligned longitudinally along one end of the unitary ball-rod scooper assembly 44, FIGS. 8-10.

A second end of the unitary ball-rod scooper assembly 44 provides a sphere sized to rotatably communicate within an opening in the drain pipe 200 side, FIGS. 8-10. The sanitary stopper 48 further provides a solid circular top portion that is sized to fit upon and seal the drain collar 202, FIG. 11. The sanitary stopper 48 cylindrical sides have slotted openings, FIGS. 8-10.

The unitary ball-rod scooper assembly 44 sphere tapers to a lip portion sized to positionally communicate with a groove in the sanitary stopper 48 bottom such that movement of the lifting rod is transferred to the sanitary stopper 48. Downward action of the lifting rod 206 lifts the scooper end 46 of the index drain 40, which in turn lifts the bottom of the sanitary stopper 48 causing the sanitary stopper 48 to separate from the drain collar 202, FIG. 8. Upward action of the lifting rod 206 lowers the scooper end 46 of the index drain 40, which in turn lowers the bottom of the sanitary stopper 48 causing the sanitary stopper 48 to seat upon the drain collar 202, FIG. 9.

An embodiment of index drain 60 includes a sanitary stopper 68 within a standard drain pipe 200 for residential basins, tubs and sinks, the drain pipe 200 having a drain collar 202, overflow holes 204 and lifting rod 206, with a quick connect, L-connector 62 affixing a lifting rod 206 bottom end to a unitary ball-rod scooper assembly 64, FIGS. 12-16. The quick connect, L-connector 62 provides one end sized to receive and hold a lifting rod 206 end. The quick connect, L-connector 62 further provides a second end sized to receive and hold one end of the unitary ball-rod scooper assembly 64, FIGS. 12-14, 16. The center portion of the quick connect, L-connector 62 is a pliable resilient plastic material allowing the first and second ends to operate through a range of acute angles from the vertical position of the lifting rod 206, FIGS. 12-14, 16. A second end of the unitary ball-rod scooper assembly 64 provides a sphere sized to rotatably communicate within an opening in the drain pipe 200 side, FIGS. 12-14, 16. The sanitary stopper 68 further provides a solid circular top portion that is sized to fit upon and seal the drain collar 202, FIG. 15. The sanitary stopper 68 cylindrical sides have slotted openings, FIGS. 12-14, 16.

An embodiment of the index drain [10, 40, or 60] provides a vandal proof lock assembly for sanitary stoppers [18, 48, or 68]. Turning the sanitary stopper [18, 48, or 68] locks the stopper bottom with a click on the respective scooper end [16, 46, or 66], e.g., FIG. 14, providing the vandal proof position with the OEM's name on the top of the respective sanitary stoppers [18, 48, or 68] facing the customer. When the sanitary stopper [18, 48, or 68] is in a vandal proof position, the stopper overflow holes are aligned with the overflow holes on the drain pipe 200, FIG. 14.

The unitary ball-rod scooper assemblies [14, 44, or 64] have a flat section so the L-connector [62] or quick connect clasps [12 or 42] do not place the scooper end [16, 46, or 66] in an upside down position, e.g., FIG. 14.

The unitary ball-rod scooper assembly 64 sphere tapers to a lip portion sized to positionally communicate with a groove in the sanitary stopper 68 bottom such that movement of the lifting rod is transferred to the sanitary stopper 68. Downward action of the lifting rod 206 lifts the scooper end 66 of the index drain 60, which in turn lifts the bottom of the sanitary stopper 68 causing the sanitary stopper 68 to separate from the drain collar 202, FIG. 13. Upward action of the lifting rod 206 lowers the scooper end 66 of the index drain 60, which in turn lowers the bottom of the sanitary stopper 68 causing the sanitary stopper 68 to seat upon the drain collar 202, FIG. 16.

A distinct advantage of the embodiments of the index drain [10, 40, or 60], FIGS. 1-16, is the ease with which the sanitary drain stopper [18, 48, or 68] can be removed from the drain 200 for cleaning the sanitary drain stopper [18, 48, or 68] and the drain 200. The sanitary drain stopper [18, 48, or 68] is simply lifted out of the drain 200 after a quarter turn of the stopper [18, 48, or 68], the only requirement being that sufficient pulling force be applied to the lifting rod 206 to release the fit connection between the scooper end {16, 46, or 66] and the sanitary drain stopper [18, 48, or 68], FIGS. 7 and 8.

For the embodiments of index drain [10, 40, or 60], all sanitary stoppers [18, 48, or 68], quick connect clasps [12 or 42], quick connect, L-connectors [62], unitary ball-rod scooper assemblies [14, 44, or 64], and scooper ends [16, 46, or 66] are constructed of high impact extruded plastics or industry standard metals, such as brass. For alternative embodiments, the components may be constructed of high-carbon plastics, graphite, or similarly light and extruded materials. For further alternative embodiments, the quick connect, L-connectors [62] could be rubber.

Another advantage of the index drain is that it can be inexpensively retrofitted or employed in large volumes, and on a large scale, in commercial buildings. In such a way, the index drain lends itself to installation in hotels, office buildings, hospitals, apartment buildings, and any kind of structure having a large number of sinks with drains, in that the sanitary drain stopper [18, 48, or 68] can be locked in place with a quarter-turn click.

A Best Mode Known to Date or a Second Mode as Shown in FIG. 17 and Beyond

FIG. 17 and beyond illustrate and demonstrate the best mode known to date. This best mode is sometimes referred to as the "diverter index drain", index drain with diverter, index drain with reference number 80 as well as other names. These and other aspects of the diverter index drain will become apparent upon reading the following detailed description in conjunction with the associated drawings.

Figure 18:
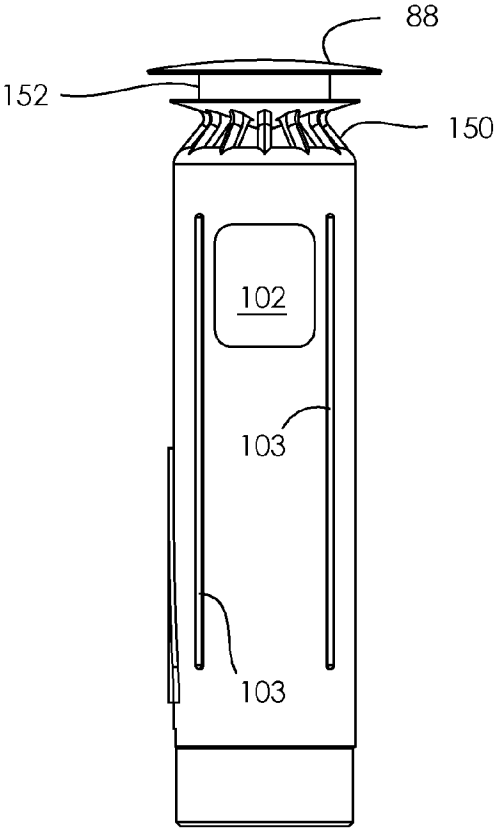
FIG. 18 is a perspective view of one embodiment of the index drain having a plurality of vertical diverters.

FIG. 17 presents a view of a disclosed diverter index drain 80 having a wedged shaped hair diverter 100. A gasket support 151 is shown to be just above an angled drain gate 150, marked in FIG. 18. FIG. 18 presents raised vertical diverters 103 that are helpful in diverting hair and other debris away from the scooper end insertion area (FIG. 17). The location of the rectangular voids 102 or overflow voids 102 in relation to the vertical diverters 103 overcomes shortfalls in the related art by directing some debris into the overflow voids. The vertical diverters 103 do not generally stop hair from traveling down the drain, but instead generally prevent hair from entangling upon the scooper end and or scooper end base.

FIG. 18 features an angled drain grate 150 with grates positioned between 30 degrees to 60 degrees from the horizontal plane. The angled drain gates 150 prevent jewelry and other larger items from entering the drain system. But, the angled drain gates allow significant water flow to drain away smaller items. The angled drain gates 150 provides excellent results in not snagging hair and creating a water flow to take hair away toward the outer surface of the diverter index drain. Hair traveling down the outer surface of the diverter index drain is guided by a plurality of vertical diverters 103 and a hair diverter 100. Hair and other debris may first be deflected by a sanitary stopper 88.

Sometimes a rubber gasket, not shown, is placed below the sanitary stopper 88 and above the gasket support 151. The optional rubber gasket may fit around the sanitary stopper support structure 152.

Figure 19:
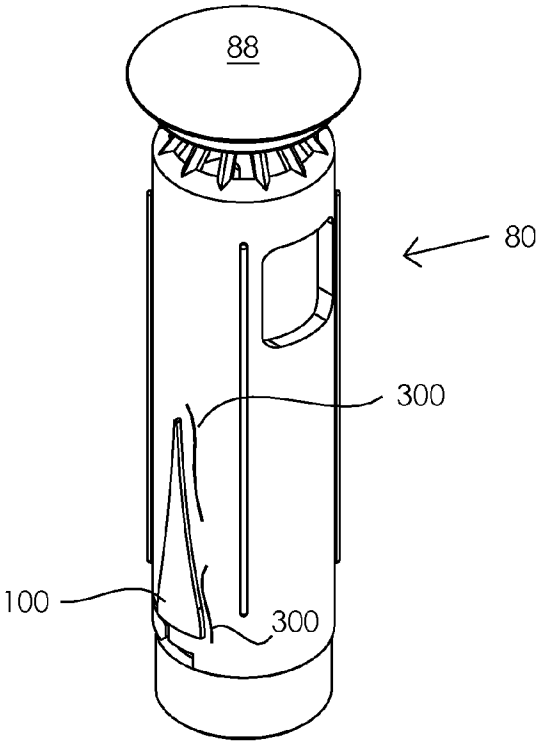
FIG. 19 is a perspective view of one embodiment of the index drain with hair being redirected by a hair diverter.

FIG. 19 shows hair 300 being diverted by a hair diverter 100 so as to direct hair away from the scooper insertion area.

Figure 20:
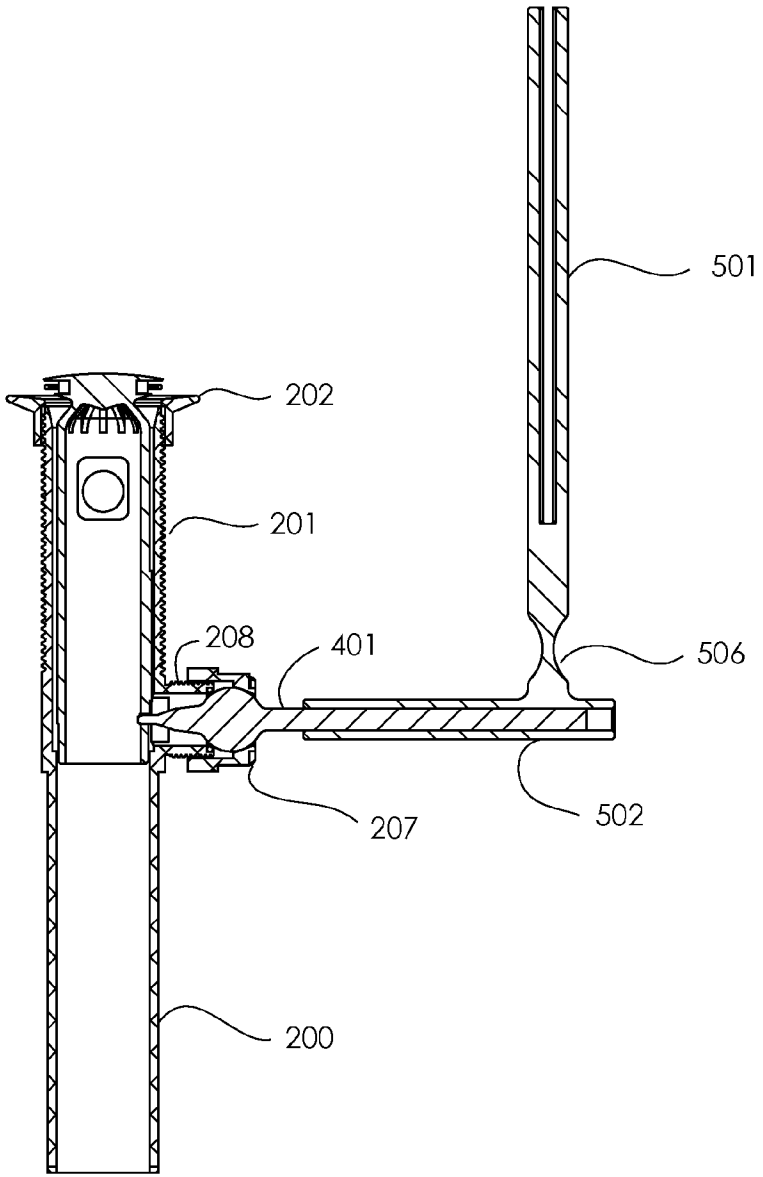
FIG. 20 is a sectional view of one embodiment of the index drain.

FIG. 20 presents a sectional view of a diverter drain contained within standard drain pipe 200. A holding chamber 208 for holding a ball is in attachment to the standard pipe. A fitting cap 207 retains the ball within the holding chamber.

The ball rod 401 is shown inserted into the horizontal section of the lifting rod boot 502. While the vertical section of the lifting rod boot is not shown at the end of the horizontal section, a configuration of placing the vertical section 501 at the end of the horizontal section 502 is contemplated.

Figure 21:
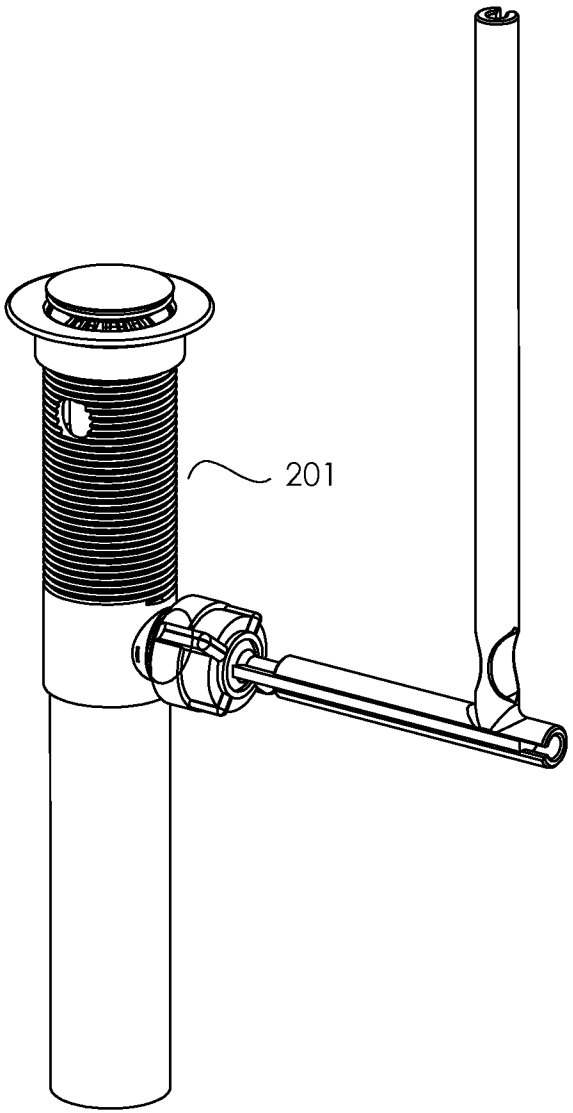
FIG. 21 is a perspective view of one embodiment of the index drain.
Figure 22:
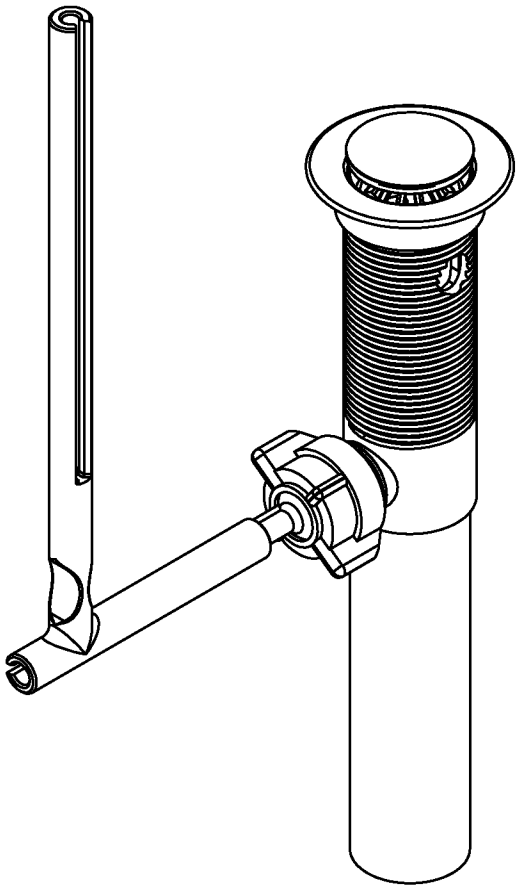
FIG. 22 is perspective view of one embodiment of the index drain.

FIG. 21 shows the treaded section 201 of a standard drain pipe and presents a perspective exterior view of an assembled system. FIG. 22 presents another perspective view of an assembled system.

Figure 23:
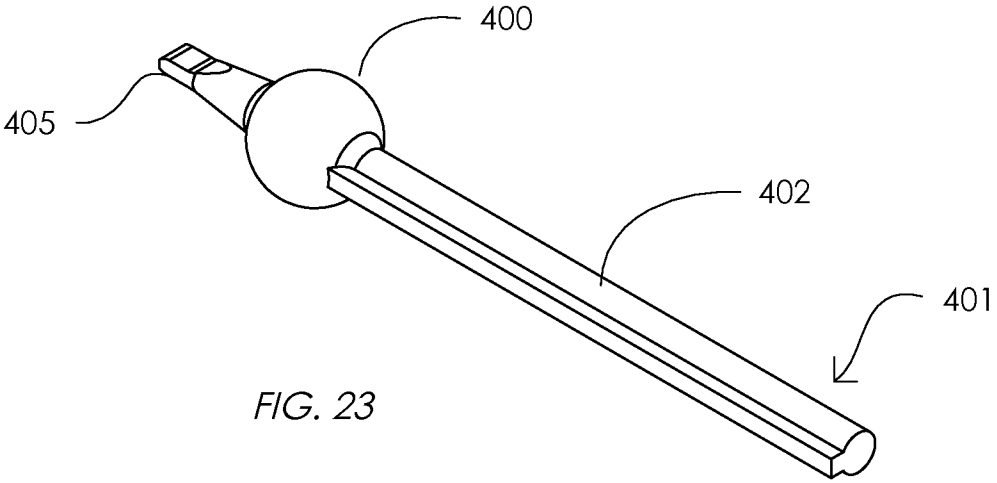
FIG. 23 is a perspective view of one embodiment of a ball rod, ball and flattened scooper end.

FIG. 23 presents a perspective view of one embodiment of a flattened scooper end 405, ball 400, and ball rod 401. A ball rod 401 may comprise circular ball rod section 402 and a protrusion section 403. The protrusion section 403 may be fitted into the fitting void 503 (FIG. 26 D) of a horizontal section 502 of a lifting rod boot.

Figure 25:
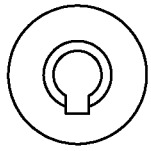
FIG. 25 is an end view of a ball rod having a protrusion section.
Figure 24:
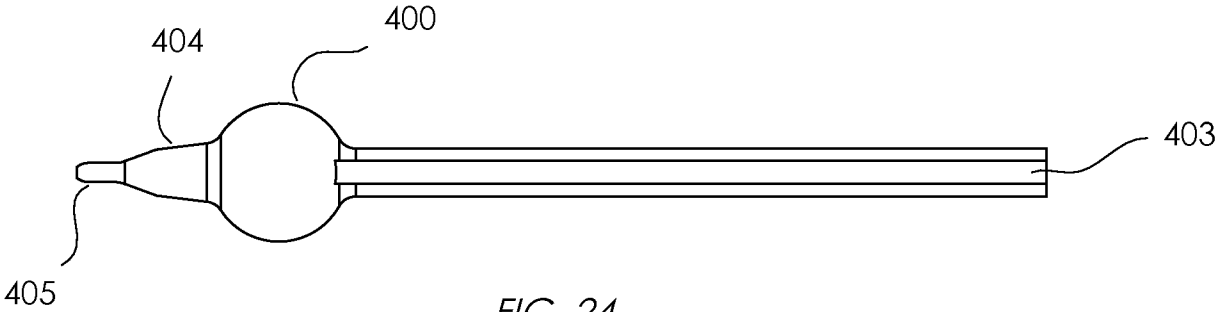
FIG. 24 is a plan view of one embodiment of a ball rod, ball and flattened scooper end.

FIG. 24 presents a ball rod assembly with a base 404 of scooper end shown. The base 404 may also be called a scooper end base. FIG. 25 presents an end view of a ball rod attached to a ball.

Figure 26:
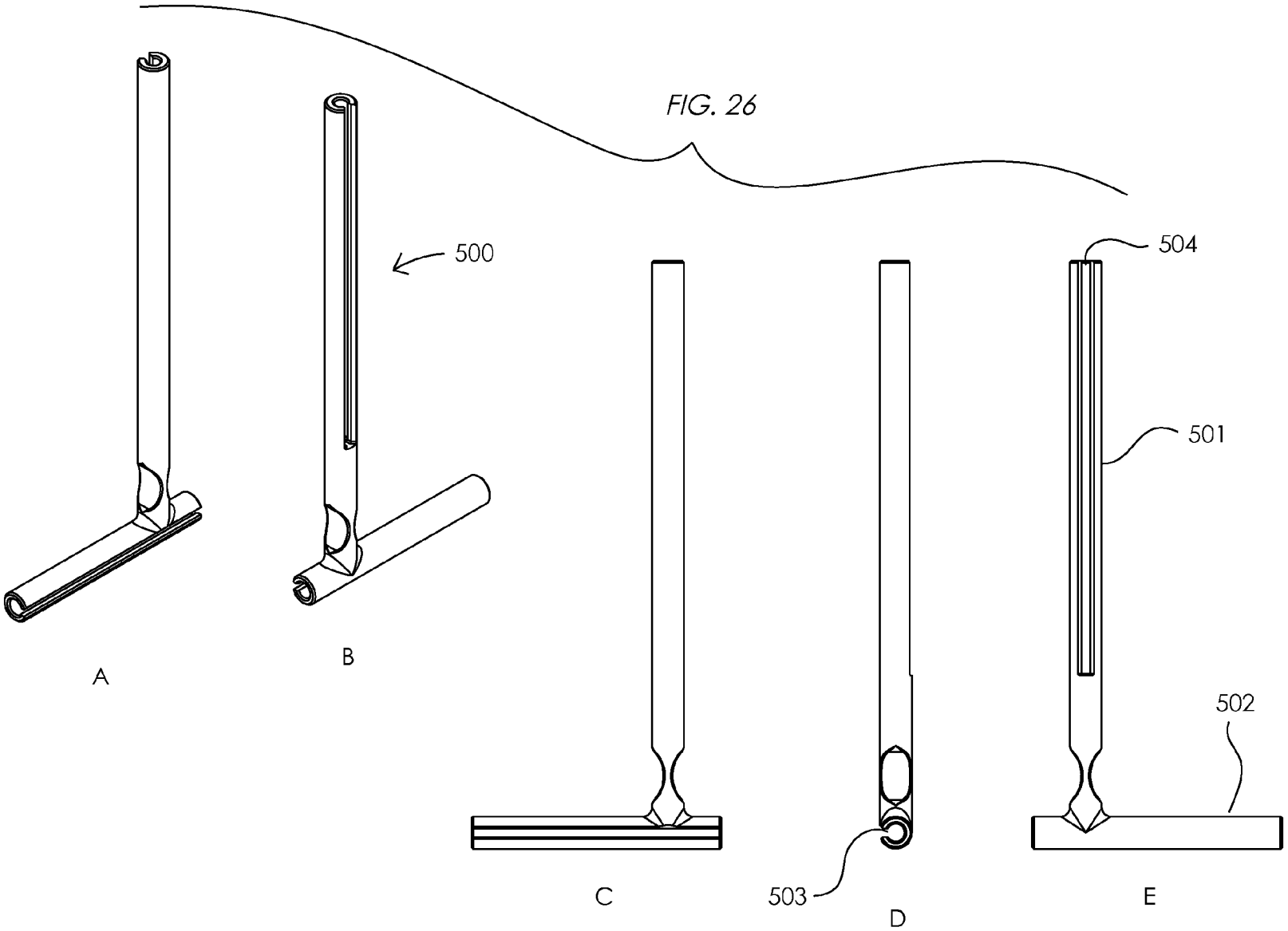
FIG. 26 presents 5 views, A-E of lifting rod boots

FIG. 26 presents views A-E of a lifting rod boot. The lifting rod boot provides advantages over the known prior art in that the lifting rod boot may be used to retro fit existing lifting rod systems. The disclosed lifting rod boot system uses center voids to hold vertical rods and horizontal ball rod components.

Figure 27:
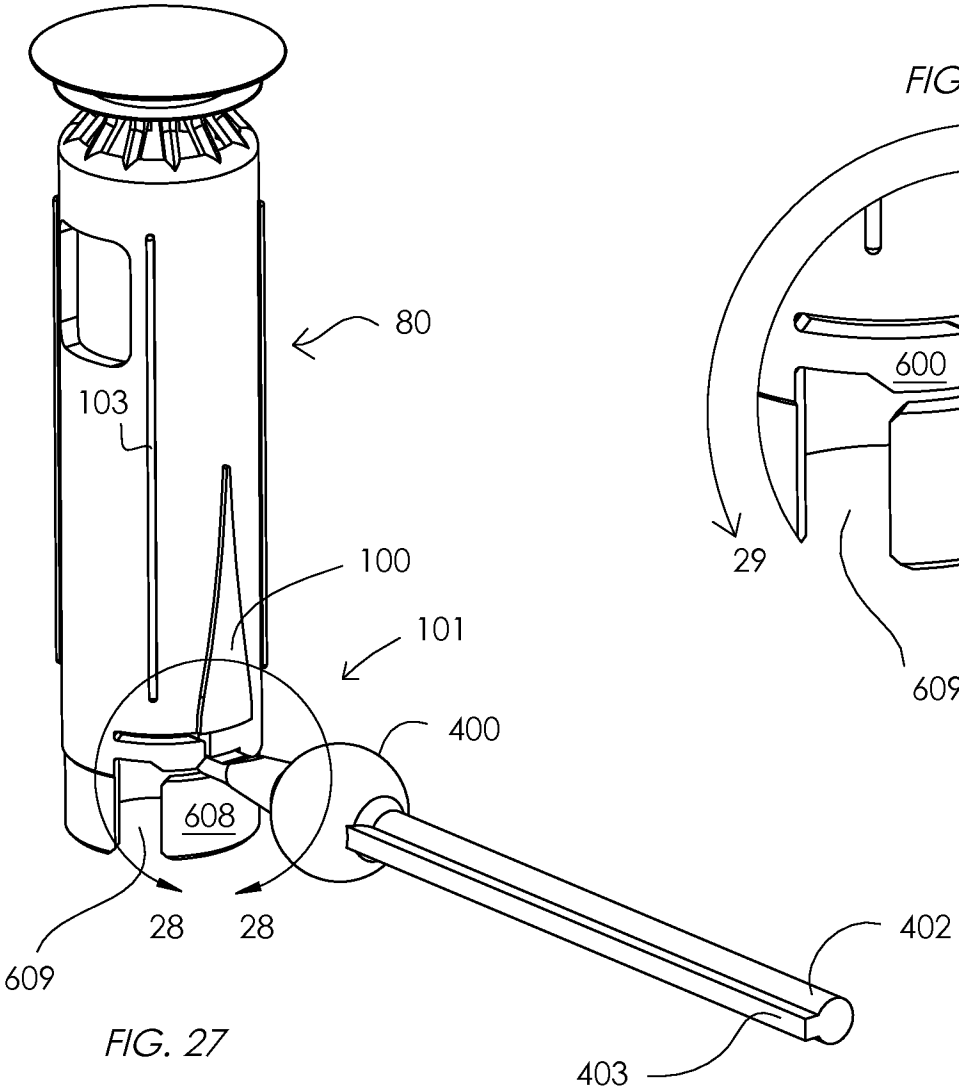
FIG. 27 is a perspective view of an index drain with diverters with a flattened scooper inserted into a scooper resting void

FIG. 27 presents a perspective view of a diverter index drain 80 attached to a ball rod section with a flattened scooper end. Circled area 28-28 shows the area depicted in FIG. 28 and depicts an area sometimes called the scooper end insertion area 101. The lower left section of the diverter index drain comprises a scooper entry section 609 which comprises a void sometimes used to introduce a flattened scooper end into the diverter index drain.

Figure 28:
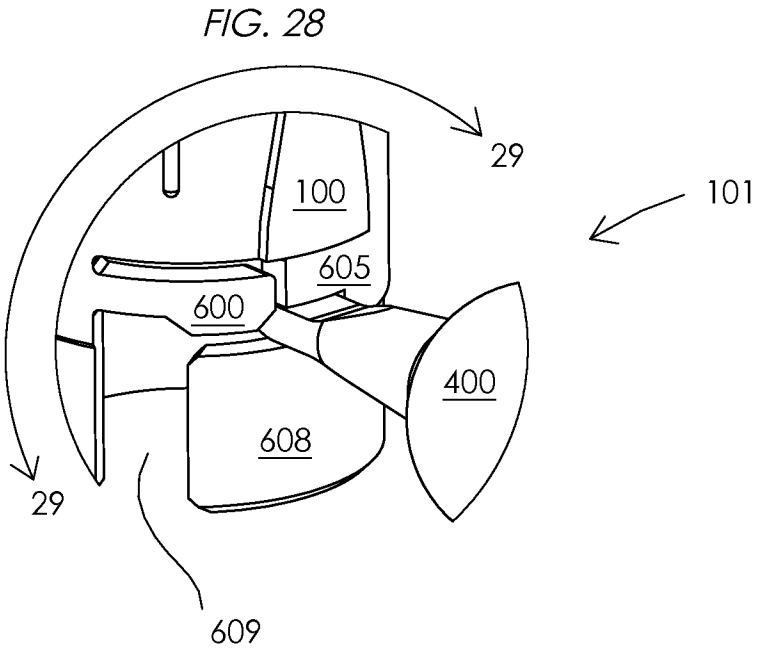
FIG. 28 is an expanded view of an index drain with diverters with a flattened scooper inserted into a scooper resting void
Figure 29:
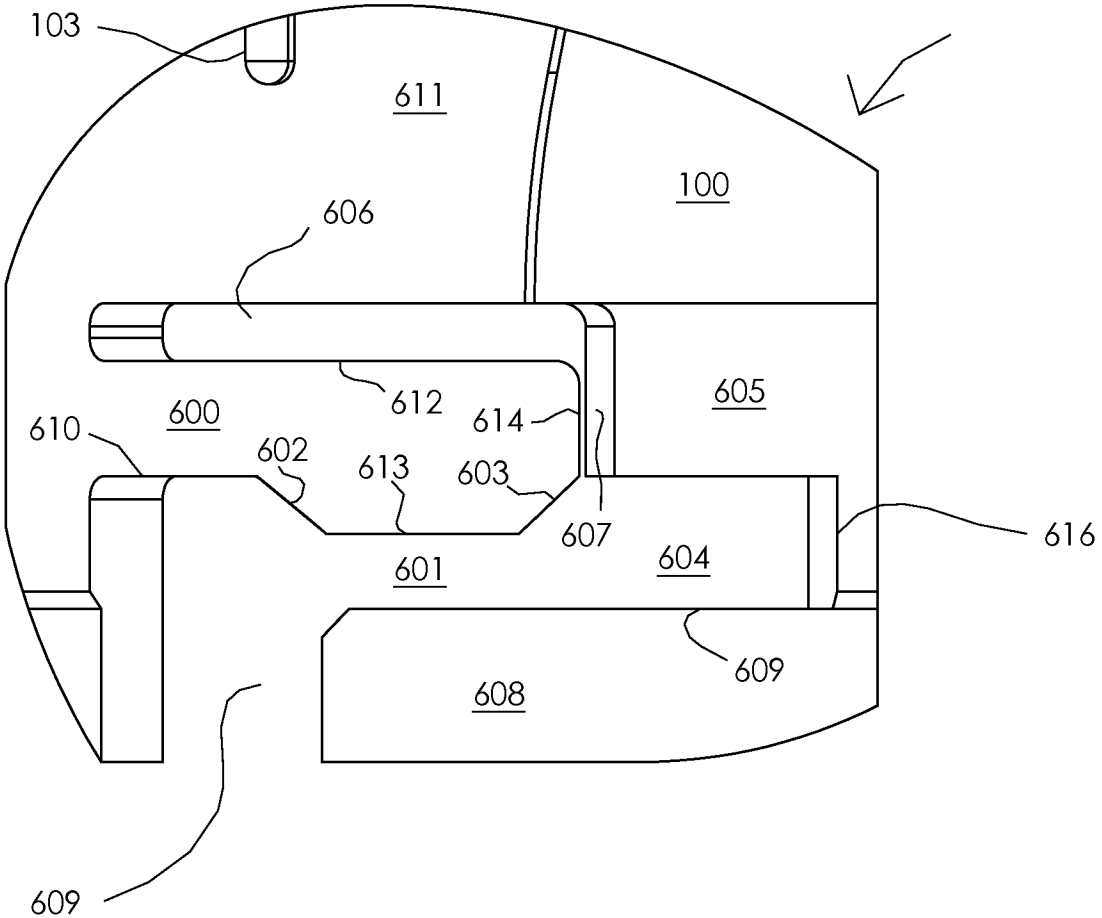
FIG. 29 is an expanded view of FIG. 28 with the flattened scooper omitted.
Figure 33:
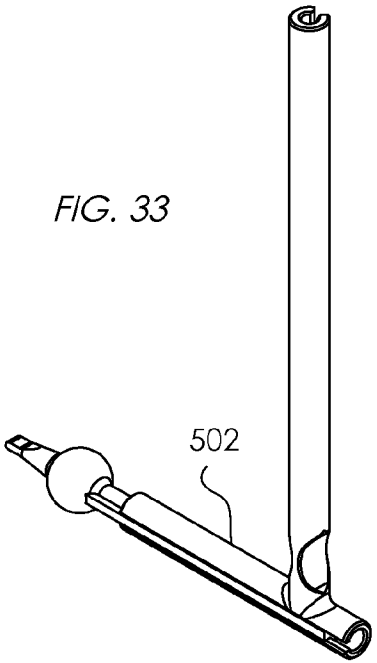
FIG. 33 is a perspective view of a ball rod inserted into a horizontal section 502 of a boot rod

FIG. 28 presents an expanded view of the scooper end insertion area 101 and presents a snap section 600. The snap section 600 moves upwardly when the scooper end is moved to and through the horizontal passageway 601 (FIG. 29). When the scooper end is placed within a scooper resting void 604 (FIG. 29) the scooper end is secured into position.

FIG. 29 presents an expanded view of scooper end insertion area 101 without a ball rod or scooper end. The snap section 600 comprises a first bottom edge 610, a first beveled ridge 602, a second lower edge 613, a second beveled ridge 603, a vertical edge 614, and an upper edge 612. A lower solid section 608 comprises an upper horizontal edge 614 and a vertical edge 616. Above the scooper resting void is a solid section 605 of the deflector index drain. A void 606 above the snap section 600 allows the snap section 600 to move upwardly while the scooper end travels through the horizontal passageway 601.

Figure 32:
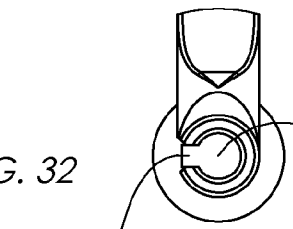
FIG. 32 is an expanded end view of a boot rod
Figure 31:
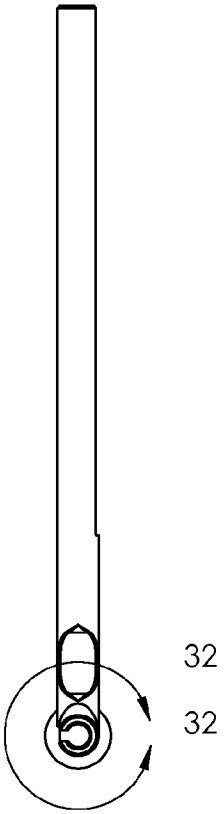
FIG. 31 presents an end view of a horizontal section of a boot rod
Figure 30:
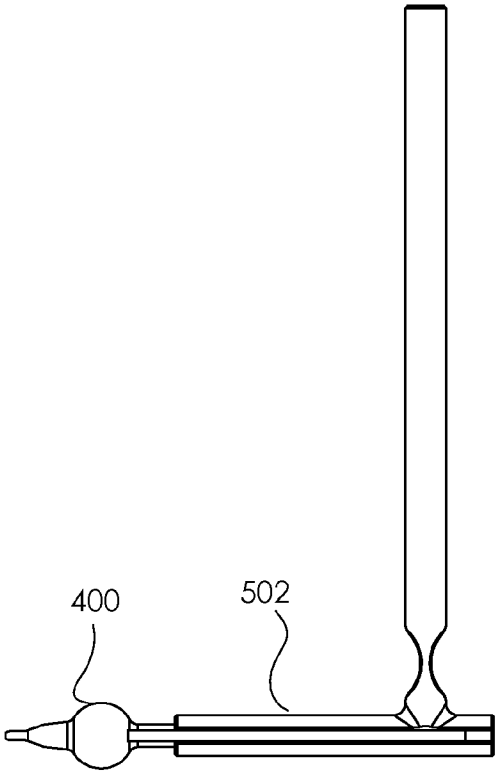
FIG. 30 is a plan view of a horizontal section of a lifting rod boot containing a ball rod.

FIG. 30 presents ball rod inserted into a horizontal section of a lifting rod boot. FIG. 31 presents an end view of horizontal section of a lifting rod boot. FIG. 32 presents an expanded view of FIG. 31 at 31-31. FIG. 32 shows a main center void 505 and a fitting void 503 of a horizontal section 502 of a lifting rod boot.

Figure 34:
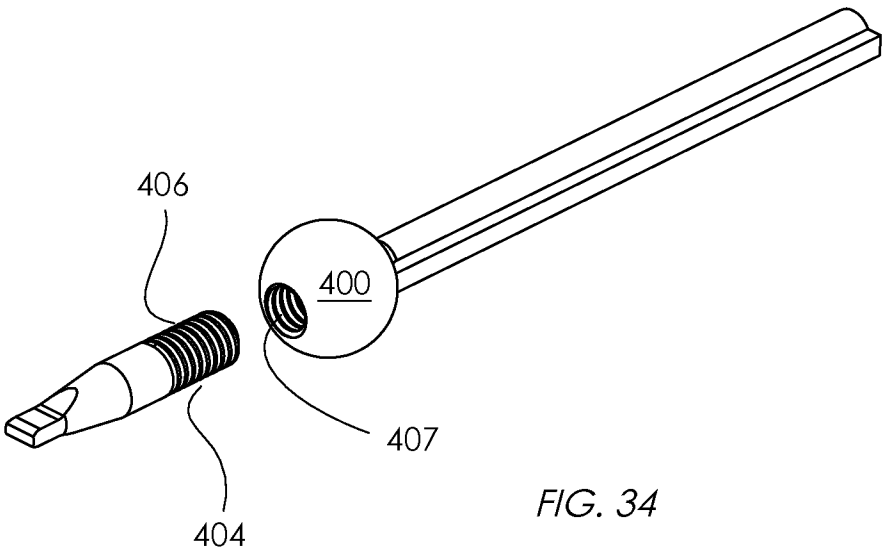
FIG. 34 is a perspective view of a ball with interior threads in position to accept a threaded scooper end or base of scooper end

FIG. 34 presents an alternative embodiment of a ball 400 having a center void with a threaded section 407. An alternative embodiment of a scooper end or scooper end base 404 is shown with a threaded section 406 suitable for insertion into the ball. In this embodiment, the length of the scooper end may be adjusted by rotation of the scooper end within the ball. Such fine and precise adjustments may help to minimize the protrusion of the scooper end into the center void of the drain. The rotating scooper end provides a tool less apparatus and method of fitting existing drains with the disclosed system.

Figure 35:
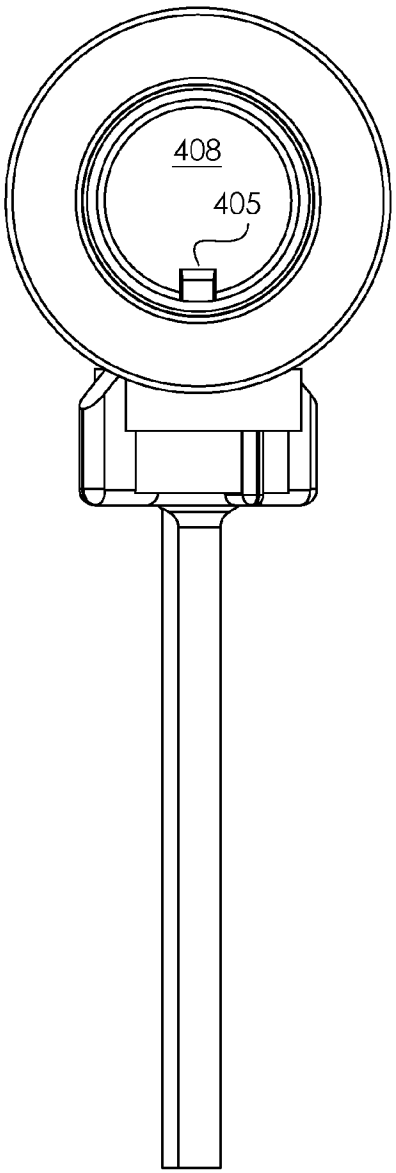
FIG. 35 is a plan sectional view of a flattened scooper end protruding into a center void of a diverter index drain

FIG. 35 presents a scooper end 405 viewed within the interior section 408 or interior void of a diverter index drain.

Figure 36:
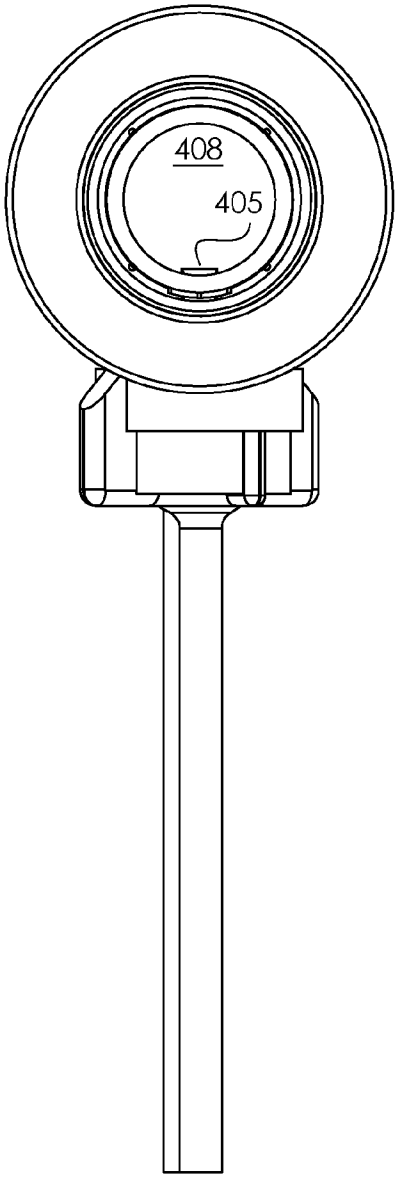
FIG. 36 is a plan sectional view of a flattened scooper end protruding into a center void of a diverter index drain
Figure 37:
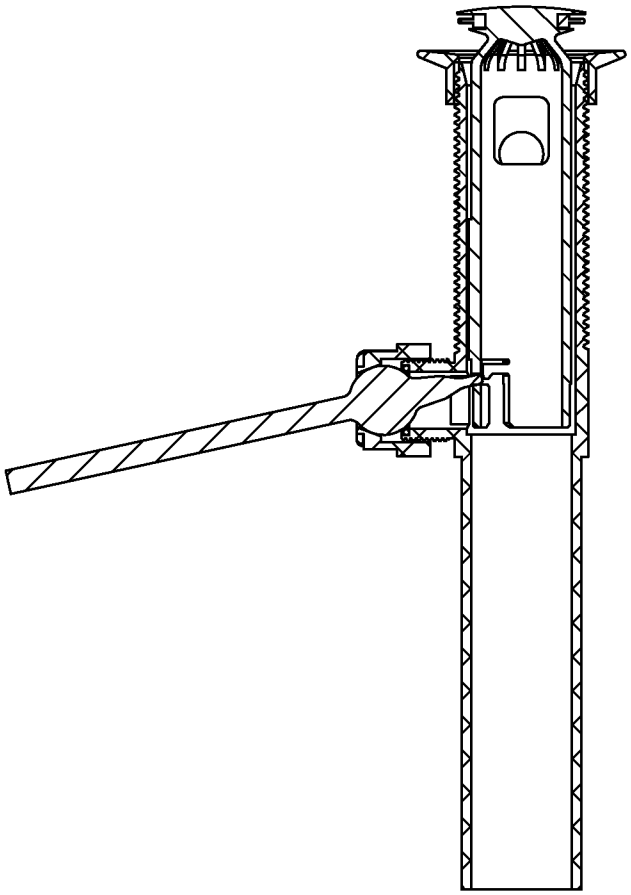
FIG. 37 is a sectional view of a diverter index drain in an up position, wherein water may flow down the drain
Figure 38:
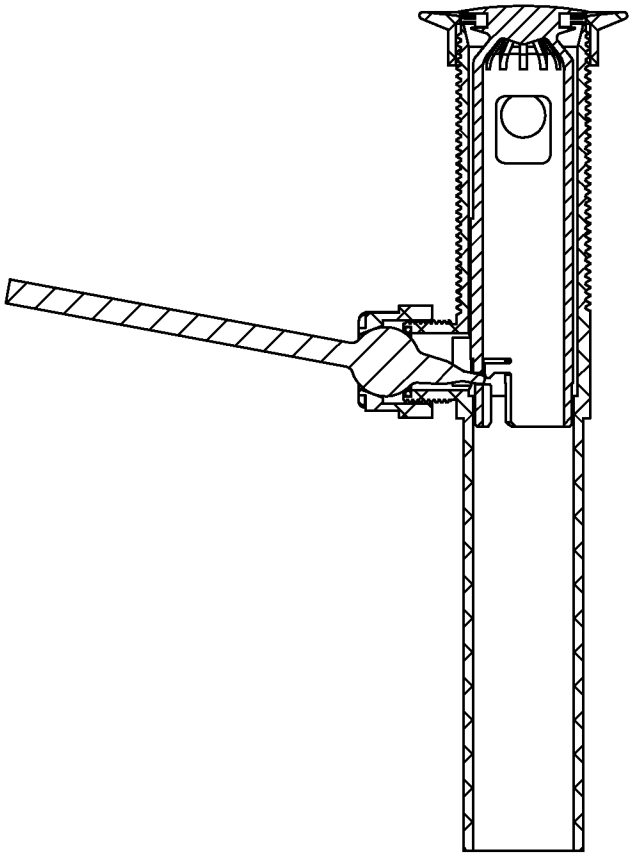
FIG. 38 is a sectional view of a diverter index drain in a closed or sealed position wherein water will not flow down the drain.
Figure 43:
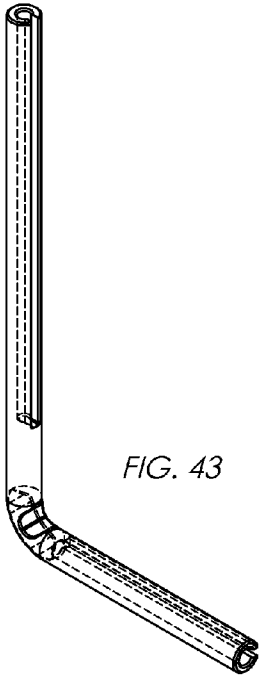
FIG. 43 is a perspective view of a L shaped lifting rod boot

FIG. 36 presents a scooper end 405 more carefully adjusted so as not to significantly extend into the interior section 408 of a diverter index drain.

FIGS. 39 to 43 present embodiments of a L shaped 550 lifting rod boot. FIG. 40 shows a living hinge joint 551 connecting a vertical section 552 to a horizontal section 553. Like the T lifting rod boot of 500, the vertical section accepts a variety of control pieces to move the stopper up and down. The horizontal section 553 accepts a variety of ball rods.

Disclosed embodiments include standalone rod boots 550 having a living hinge 551, a vertical section 552 for accepting vertical control rods (not shown) and a horizontal 553 section for accepting a ball rod or similar element. The T and L lifting rod boots are well adapted to replace the bulky systems of the prior art. The disclosed T and L lifting rod boots work well in meeting ADA requirements that disallow sharp edges under a sink. The disclosed T and L lifting rod boots use a combination of hard and soft rubbers to secure a plethora of ball rods and vertical control lifters.

Disclosed embodiments include a screw type sanitary stopper being rotatable in order to adjust the height of the sanitary stopper 88.

Embodiments of the disclosure include index drains with stopper tops 88 being screwed on to an index drain to accommodate various elevations of pre-existing openings. The disclosed index drains may fit preexisting drain bodies.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventor contemplates the various aspects of the invention in any number of claim forms.

Embodiments of this disclosure include, but are not limited to the following items. Item terms may include reference numbers to drawn components, but such reference numbers or drawn components do not limit the meaning of such terms found within the items or claims.

A kit for retro fitting existing drains, the kit comprising:

a) a diverter index drain 80 comprising a sanitary stopper 88, a gasket support 151, a plurality of angled drain gates 150, one or more overflow voids 102, a plurality of vertical diverters 103, a hair diverter and scooper end insertion area; and b) a ball rod assembly, comprising a flattened scooper end 405, a ball 400, and a ball rod 401, with the ball rod 401 comprising circular ball rod section 402 and a protrusion section 403.

Item 2. The kit of item 1 wherein:

the scooper end insertion area 101 comprises a scooper entry void 609, leading to a horizontal passageway 601, which in turn leads to a scooper resting void 604 and wherein a snap section 600 defines the upper edges of the scooper entry void 609 and horizontal passageway 601.

Item 3. The kit of item 2 wherein the snap section 600 includes a first bottom edge 610, connected to an angled first beveled edge 602, connected to a second bottom edge 613, connected to an angled second beveled edge 603, connected to a vertical edge 614, connected to a upper edge 612.

Item 4. The kit of item 3 including a lifting rod boot 500, the lifting rod boot comprising a vertical section 501 connected to a horizontal section 502 wherein the horizontal section comprises a main center void 505 and a fitting void 503 such that the fitting void 503 of the horizontal section accepts the protrusion section 403 of the ball rod and wherein the circular ball rod section 402 may be accepted by the main center void 505 of the ball rod.

Item 5. The kit of item 4 wherein the vertical section 501 of the lifting rod boot comprises a fitting void 504 and a main center void.

Item 6. The kit of item 5 wherein the ball rod comprises a flattened scooper end having threads suitable for insertion into a ball having a center void with threads.

Item 7. The kit of item 6 wherein the ball rod comprises a flattened scooper end 405 attached to a scooper end base 404 and the scooper end base has threads suitable for insertion into a ball having a center void with threads.

Item 8. The kit of item 7 wherein the diverter index drain 80 includes a sanitary stopper 88 attached to a sanitary stopper support structure 152 and wherein the sanitary stopper is connected to the sanitary stopper by rotational threads, allowing for height adjustments of the sanitary stopper.

What is claimed is:

1. A kit for retro fitting existing drains, the kit comprising:

a) a diverter index drain comprising a sanitary stopper, a gasket support, a plurality of angled drain gates, one or more overflow voids, a plurality of vertical diverters, a hair diverter and a scooper end insertion area; and b) a ball rod assembly, comprising a flattened scooper end, a ball, and a ball rod, the ball rod comprising a circular ball rod section and a protrusion section.

2. The kit of claim 1 wherein: the scooper end insertion area comprises a scooper entry void, a horizontal passageway, a scooper resting void and a snap section.

3. The kit of claim 2 wherein the snap section includes a first bottom edge, an angled first beveled edge, a second bottom edge, an angled second beveled edge, a vertical edge, and an upper edge.

4. The kit of claim 3 including a lifting rod boot, the lifting rod boot comprising a vertical section connected to a horizontal section and the horizontal section comprising a main center void and a fitting void.

5. The kit of claim 4 wherein the vertical section of the lifting rod boot comprises a fitting void and a main center void.

6. The kit of claim 5 wherein the ball rod comprises a flattened scooper end having threads, and the kit further comprising a ball having a center void with threads.

7. The kit of claim 6 wherein the ball rod comprises a flattened scooper end attached to a scooper end base and the scooper end base comprises threads.

8. The kit of claim 7 wherein the diverter index drain includes a sanitary stopper attached to a sanitary stopper support structure.

9. A diverter index drain comprising: a) a diverter index drain comprising a sanitary stopper, a gasket support, a plurality of angled drain gates, one or more overflow voids, a plurality of vertical diverters, a hair diverter and scooper end insertion area; and b) a ball rod assembly, comprising a flattened scooper end, a ball, and a ball rod, with the ball rod comprising a circular ball rod section and a protrusion section.

10. The diverter index drain of claim 9 further comprising: the scooper end insertion area further comprising a scooper entry void, a horizontal passageway, a scooper resting void, and a snap section.

11. The diverter index drain of claim 10 further comprising a lifting rod boot, the lifting rod boot comprising a vertical section connected to a horizontal section wherein the horizontal section comprises a main center void and a fitting void.

12. A kit for replacing existing drain valve ball levers and plunger levers the kit comprising: a lifting rod boot, wherein the lifting rod comprises a vertical section having an longitudinal opening; and wherein the vertical section is attached to a horizontal section and wherein the horizontal section comprises a center void.

13. The kit of claim 12 wherein the horizontal section of the lifting rod boot further comprises a fitting void.

* * * * *